US005429248A

United States Patent [19]

Le Gigan et al.

[11] Patent Number: 5,429,248

[45] Date of Patent: Jul. 4, 1995

[54] GRAIN PROCESSOR

[75] Inventors: Dominique Le Gigan, La-Garenne, France; David A. Heiman, Elgin, Ill.; Donald C. Hay, Sullivan, Wis.

[73] Assignee: Star Partners, Chicago, Ill.

[21] Appl. No.: 8,004

[22] Filed: Jan. 22, 1993

Related U.S. Application Data

[63] Continuation-in-part of Ser. No. 666,782, Mar. 8, 1991, Pat. No. 5,181,616.

[51] Int. Cl.[6] ..... B07B 9/00

[52] U.S. Cl. ..... 209/33; 209/239; 209/290; 209/390

[58] Field of Search ..... 209/390, 30–35, 209/154, 237, 239, 290, 297, 546, 550

[56] References Cited

U.S. PATENT DOCUMENTS

| | | | |
|---|---|---|---|
| 261,653 | 7/1882 | Bayley | 209/290 X |
| 1,301,277 | 4/1919 | Kronenberg | 209/32 |
| 1,515,757 | 11/1924 | Rylander | 209/290 |
| 1,771,996 | 8/1930 | Chapman | 209/290 X |
| 1,845,441 | 2/1932 | Robertson | 209/34 |
| 2,696,861 | 12/1954 | Egedal . | |
| 2,782,926 | 2/1957 | Saxe | 209/239 X |
| 3,005,547 | 10/1961 | Freeman . | |
| 3,036,706 | 5/1962 | Taudiere | 209/297 X |
| 3,181,370 | 5/1965 | Dietert . | |
| 3,439,800 | 4/1969 | Tonjes . | |
| 4,312,750 | 1/1982 | Braun et al. . | |
| 4,469,230 | 9/1984 | Gorlitz et al. | 209/390 X |
| 4,588,091 | 5/1986 | Wade . | |
| 4,634,522 | 1/1987 | Edholm et al. . | |
| 4,840,727 | 6/1989 | Humphrey . | |
| 4,896,835 | 1/1990 | Fahrenholz | 209/390 X |
| 4,991,721 | 2/1991 | Misra et al. . | |
| 5,021,150 | 6/1991 | Bürklin | 209/290 X |
| 5,032,256 | 7/1991 | Vickery | 209/154 X |
| 5,181,616 | 1/1993 | Le Gigan . | |

FOREIGN PATENT DOCUMENTS

| | | | |
|---|---|---|---|
| 2605252 | 4/1988 | France | 209/239 |
| 2643835 | 9/1990 | France . | |
| 2312333 | 9/1974 | Germany | 209/239 |
| 696296 | 11/1979 | U.S.S.R. . | |

OTHER PUBLICATIONS

"Seedburo Equipment Company Catalog 91," published by Seedburo Equipment Company, Chicago, Ill., (1991) pp. 2–3.

*Primary Examiner*—D. Glenn Dayoan

*Attorney, Agent, or Firm*—Willian Brinks Hofer Gilson & Lione

[57] ABSTRACT

A grain processor for separating and measuring components of a sample of grain as it passes through a rotary sieve having two or more sieving sections having different perforations so that selective separation is made on the basis of the size of the particles in the sample.

57 Claims, 14 Drawing Sheets

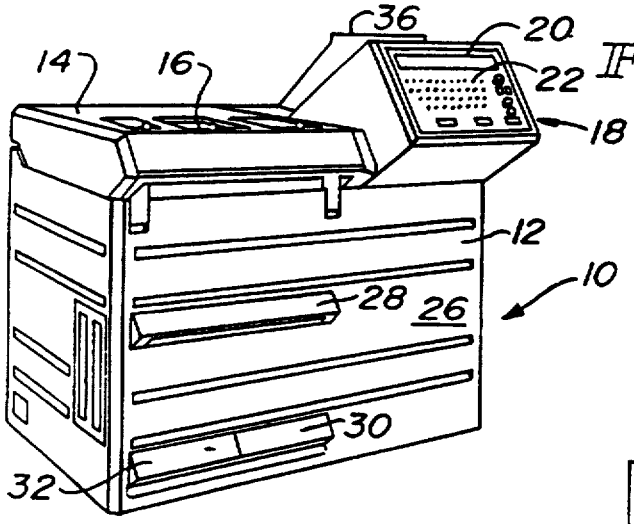
FIG.1
FIG.2
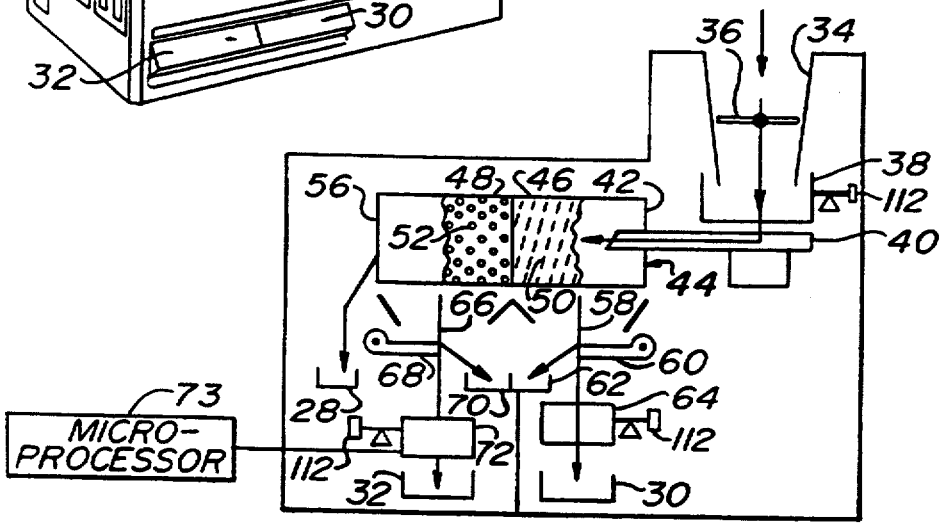
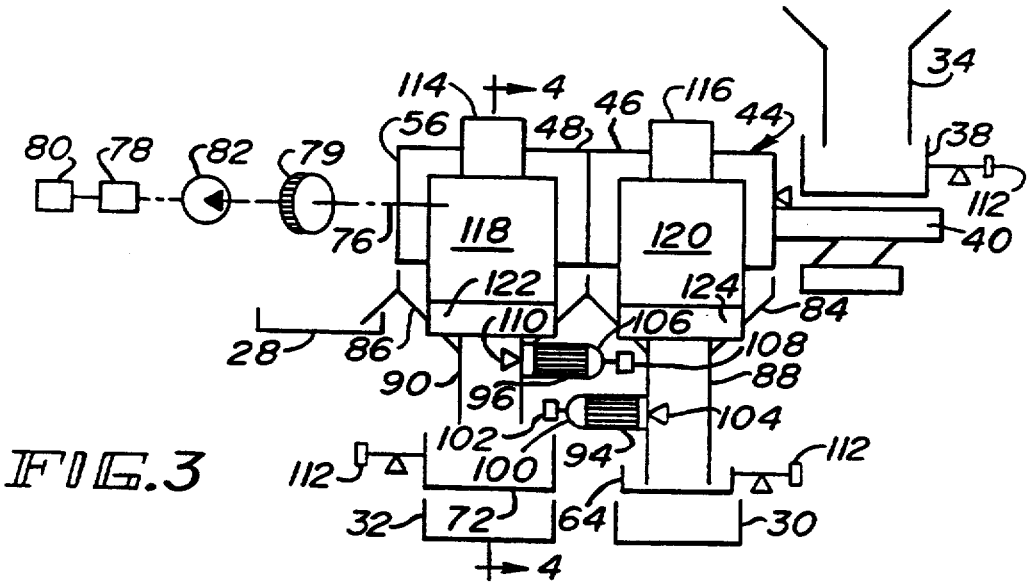
FIG.3

Fig. 20
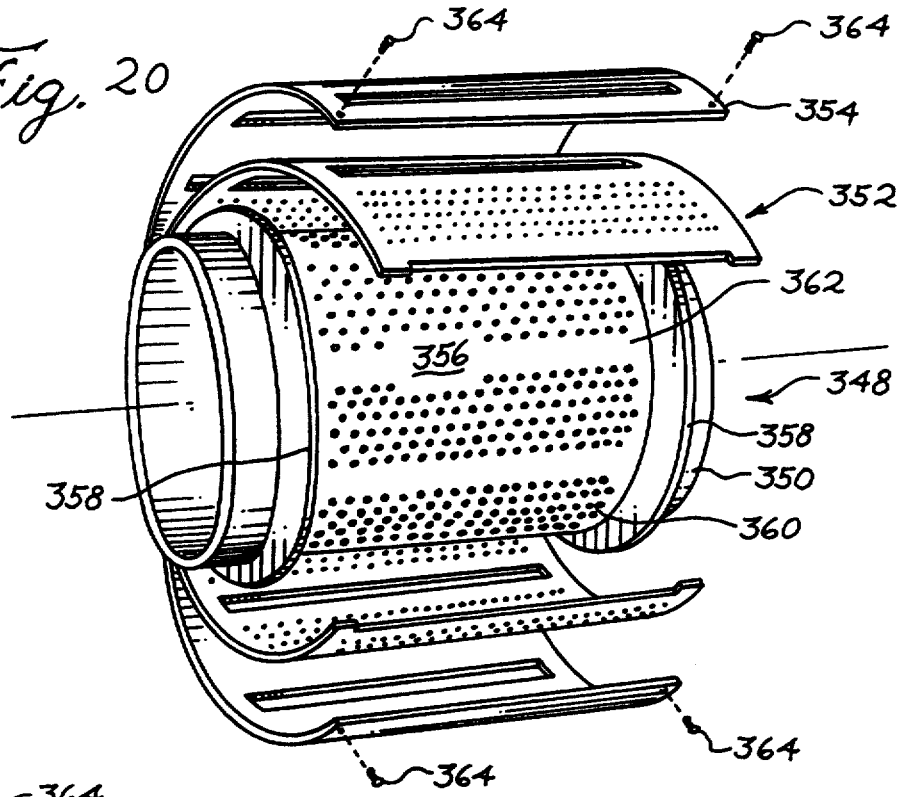
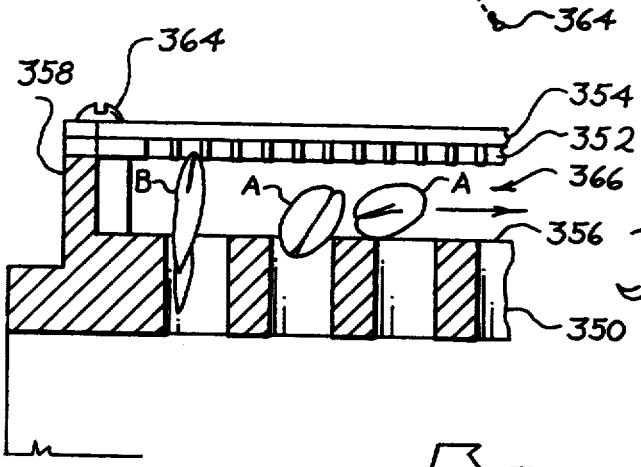
Fig. 22
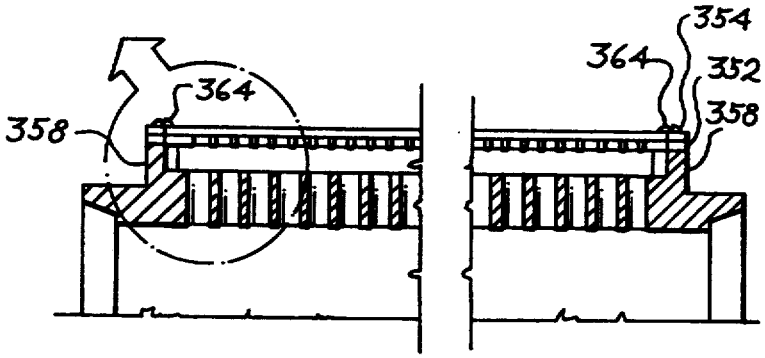
Fig. 21

372
372
354
352

368
370
356

360
362

GRAIN PROCESSOR

The present application is a continuation-in-part application of U.S. application Ser. No. 07/666,782, filed on Mar. 8, 1991, which is now U.S. Pat. No. 5,181,616, and whose disclosure is incorporated herein by reference.

BACKGROUND OF THE INVENTION

1. Field of the Invention

This invention is concerned with apparatus for separating different constituents of a sample of granular products, and more particularly with apparatus for separating various types of impurities mixed with grain, as well as separating broken and undersized grain from whole grain.

2. Description of the Prior Art

A grain abrading and cleaning apparatus is described in U.S. Pat. No. 2,696,861, wherein dust, flakes, and other impurities are removed from grain. U.S. Pat. No. 4,312,750 is a grain-cleaning apparatus which is mobile in nature and is based upon an inclined rotating screen drum. By means of rotating screen drums, foreign material is separated from grain. U.S. Pat. No. 4,840,727 describes a grain cleaner and an aspirator, wherein banks of decks are gyrating in a flat, horizontal plane, to move a sample of grain contaminated with impurities. An inspirator is used to move and separate the particles in a grain sample. In the foregoing patents, there is no provision for separating broken and undersized grain from whole kernels. In French Patent No. 8902764 there is described an automatic laboratory grain cleaner known as "the NSA system", wherein a whole sample is introduced into a weighing hopper and then routed by a vibrating distributor to a double-perforation cylindrical screen where dust and broken or undersized grain are extracted through a first perforated zone and then the good grain and middle-sized foreign material is extracted through a second perforated zone. Big-sized foreign materials are collected at the exit of the perforated zones. Blowers are used in conjunction with the cylindrical screen to assist in the separation of the foreign particles from the grain.

The devices described in the U.S. Patents also do not have any facilities for separating the components of a mixture and then identifying or classifying the separated components. On the other hand, the NSA system described in the French Patent separates the grain and the impurity particles to provide a percentage of foreign material, broken grain, and total defects, but is not accurate because of possible variation in the blower speeds and rotating screen speed.

SUMMARY OF THE INVENTION

To overcome the disadvantages of the known devices and apparatus, the present invention is directed to an apparatus which will precisely separate various particles in a sample of a grain mixture.

It is in fact necessary to effect this kind of sorting or separating in order to remove the impurities from the good grain and, more particularly, when it is a sample, to separate the impurities in order to determine their proportion in comparison to the total amount of the sample or in comparison to the amount of good grain.

The impurities differ from the good grain by their size and/or density. For example, the following can be achieved in the separation of a grain mixture:

Good grain or good product,

Dust (fine and light particles),

Broken or small grain having possibly a density comparable to that of the good grain but of inferior dimensions, Medium impurities having dimensions comparable to those of good grain but of inferior density, Large impurities having different densities but having dimensions which are larger than those of the good grain.

It is already known to separate grain from impurities by means of densimetric systems, or by sieving. The sieving can be obtained with a horizontal flat surface which is agitated or with a cylinder surface which is rotated. In the flat-type sieving, sieves of different mesh are superposed and vibrated. As a result of gravity, the particles in the grain sample will move from one sieve to another. In a rotary cylinder sieving, the grain sample circulates in a cylindrical sieve with increasing perforations. As usual, gravity is responsible for moving the particles through the different perforations in the sieve.

It is clear that a pure densimetrical sorting is not effective in separating light impurities. Therefore, it is necessary to resort to an aspiration method, which may present a problem of uniform regulation for flow of air and requires the use of a cyclone to recuperate the dust.

In order to have a complete sorting of a sample containing various granules, the invention proposes a cleaner-separator which is remarkable in that it comprises a sieving system furnished with at least one evacuation circuit for the sifted product which crosses a lower part of a column of densimetrical separation provided at its lower extremity, under and in communication with an evacuation system provided with a blower, and at its other extremity, with a decompression chamber. At least one recovery receptacle is installed under the decompression chamber, and another receptacle is installed at the extremity of the evacuation circuit.

It is preferred that the sieving system be provided with several zones of perforations of different sizes, each zone being provided with an evacuation system and a densimetrical separation column. The sieving system consists of a rotary cylinder type and is provided at one of its open extremities with a recovery receptacle for receiving the large impurities, while the other extremity is adapted to receive a test sample. In such a case, the rotary sieving cylinder can, for example, have two zones of different perforations, while a duct funnel is provided under each of the zones to bring the sifted product into its evacuation circuit towards its column of densimetrical separation. Such sieving cylinder can be provided with an interior spiral to facilitate the movement of the test sample from one extremity to the other extremity of the cylinder. The inventive apparatus is provided with various drawers for receiving the grain particles separated from a test sample. In particular, the test sample is weighed originally, and then, during the process, it is separated into one receptacle collecting dust and a drawer for collecting the broken and small grains. The separated good grain is collected in another weighing hopper, and then deposited into a good grain drawer while medium-sized light impurities go into another drawer. Finally, the larger impurities fall out of the exit of the rotary sieve into a recovery drawer. By using different weighing hoppers, it is possible to determine the percentage of good and broken grain realized from a test sample. By using a console provided with a viewing screen, keyboard, and an external printer, the results of the weighing process can be indicated on the screen and on a tape. Although the grain processor can be used independently, it can be connected to a computer that can be connected itself to a central processing unit (CPU) at an agricultural headquarters which receives inputs from consoles located at other farm agencies, the agricultural headquarters being responsible for controlling and setting standards for the grading of various grains in the various farm districts. To obtain uniform results in measurements of the particles in a test sample, blower speeds and sieve speed have to be uniform and consistent for all equipments. For achieving this result, two different ways can be used. In the first way, three black boxes containing motorized potentiometers are used. Two are used for setting respectively the air velocity in each of two separation columns, and the third one is used for setting the rotational speed of the cylindrical rotating screening system. The value of the potentiometer may be adjusted either manually by means of a knob on a console or automatically by an electric motor incorporated in the black box. The actual position of the potentiometer may be read at any moment by a microprocessor located in the console. This achieved by means of an optically coded disc integrated in the black box and which disc rotates on a shaft coupled to the potentiometer. Thereby, this is an absolute coding allowing one to know the actual position of the potentiometer without having to get back to a reference position after each power-on/power-off sequence in using the apparatus. Tachometers are used in conjunction with the blowers and the rotary sieve to indicate the actual value of the rotational speeds of the blowers and the rotating sieve. By measuring the speed of rotation of the blower, a precise air flow can be obtained without the necessity of using Pilot tubes or other flow or pressure sensors in the columns. The tachometers are electro-magnetic sensors which generate a pulse each time a metallic element on a rotating part passes an active surface. For example, one tachometer can be installed in the proximity of the blades of each blower. Another tachometer can be used to detect movement of the teeth on a gear which drives the rotary cylindrical screening system. The pulse frequencies are measured by the microprocessor in the console which then provides output signals for controlling motors which drive the blowers and the cylindrical screening system.

In the second way, the motorized potentiometers are replaced by up and down arrows on a keyboard of a console. The potentiometers themselves do not exist any more, and they are replaced by a solid-state electronic interface which is driven by a microprocessor.

Remote control of the present invention is possible and can be accomplished by using the hardware and software capabilities offered by the NSA system. Assuming that the air velocity in the column is correlated to the blower speed, the blower pulse frequency is an absolute representative function of the air flow. As a result, units of the present invention located at different offices in different places may be remotely programmed from one site (CPU) by a computer, such as in the NSA system. Remote programming is possible, because of the speed information input obtained on a master CPU which serves as a reference, such as disclosed in the NSA system. The blower speed and the speed of the rotary screen have to be the same for a particular grain on every unit of the present invention, such as disclosed in the NSA system. Each of the weighing hoppers, also known as load cells, is provided with a lock-down device to protect the sensitive measuring elements during transport. The lockdown device may comprise an elongated member generally located below the bottom of a hopper, which member, is one position, supports the hopper in a housing, and, in another position, releases the hopper to move with respect to the housing.

The main object of the invention is to provide a grain processor for performing measurements and computations necessary to obtain the contents of a grain sample.

A further object of the invention is to provide a grain processor adapted to perform the required measurements and computations automatically, and to provide a readout representative of the sample as analyzed regarding the percentage of good grain and impurities.

A further object of the invention is to provide an analysis instrument integrally arranged in a cabinet containing various drawers for receiving differently separated grain particles and internally associated with a console provided with microprocessor means for providing an output based on the amount of impurities in a test sample and on the type of grain being tested.

A still further object of the invention is to provide a grain processor provided with a console containing microprocessor means and connectable to a main headquarters central processing unit which establishes the standards and qualities for different grains to be tested.

A still further object of the invention is to provide a grain processor associated with a console containing microprocessor means receiving inputs from sensors indicating speeds of the various rotating devices incorporated in the grain processor to control and correlate the rotational speeds of the moving elements to achieve a predetermined velocity in evacuation circuits.

Another object of the invention is to provide a console provided with electrical controllers calibrated for setting the rotational speeds of motors coupled to blowers and the cylindrical rotary sieve.

A further object of the invention is to provide a lock-down device for protecting weighing and associated scales used in the grain processor.

Still another object of the invention is to provide a grain processor for separating and measuring components of a test sample of grain, wherein a motor driven rotary sieve receives the test sample and has at least two sieving sections, different sections provided with different size perforations, funnels for directing sifted portions to densimetric columns, a motor driven blower being associated with each column for separating impurities from the grain, a weighing hopper coupled to an output of each column for weighing the separated grain and providing a weight signal, a console provided with data processing and recording circuits and including microprocessor means, rotation control circuits associated with the blowers and the rotary sieve and located in the console, means for feeding the weight signals to the console, a speed reading device associated with each blower and the rotary sieve for providing a speed signal input to the respective rotation control circuits in the console, a motor controller connected to each motor, each of the rotation control circuits providing an input signal used to control the speed of the respective motor associated with a blower to maintain a desired air velocity in the respective densimetric separator column, or associated with the rotary sieve for maintaining its rotation speed.

The foregoing, as well as other objects, features, and advantages of the present invention will be appreciated from consideration of the following detailed description together with the accompanying drawings in which like reference numerals are used throughout to designate like elements and components.

BRIEF DESCRIPTION OF THE DRAWINGS

FIG. 1 is a perspective view of an embodiment of a grain processor;

FIG. 2 is a schematic view of the components of the embodiment of the grain processor of FIG. 1;

FIG. 3 is a different type of a schematic of the various components comprising the embodiment of the grain processor of FIG. 1;

FIG. 20 is an exploded view of an embodiment of a wheat and wild oats screen;

FIG. 21 is a cross-section of the wheat and wild oats screen embodiment of FIG. 20;

FIG. 22 is an enlarged view of the cross-section of FIG. 21;

DESCRIPTION OF THE PREFERRED EMBODIMENT

Figure 4:
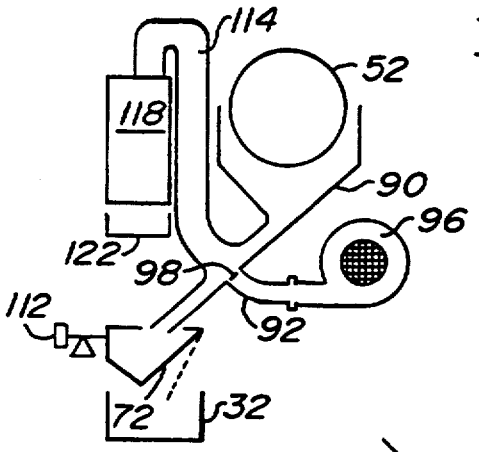
FIG. 4 is a cross-sectional view of FIG. 3 along the lines IV—IV.

Referring to FIG. 1, there is shown a grain processor 10 having a cabinet 12 having an upper portion 14 provided with a hopper opening 16 for receiving a measured quantity of a grain sample into a feed hopper 34. The upper portion 14 may be opened for changing the rotary sieves in accordance with the type of grain to be analyzed. The upper portion 14 is provided at one side with a console 18 provided with a display screen 20 and a keyboard 22. The cabinet 12 has a front face 26 provided with a drawer 28 for receiving separated types of dockage, a drawer 30 for receiving separated broken grain and undersized grain, and a drawer 32 for receiving good grain.

Figure 5:
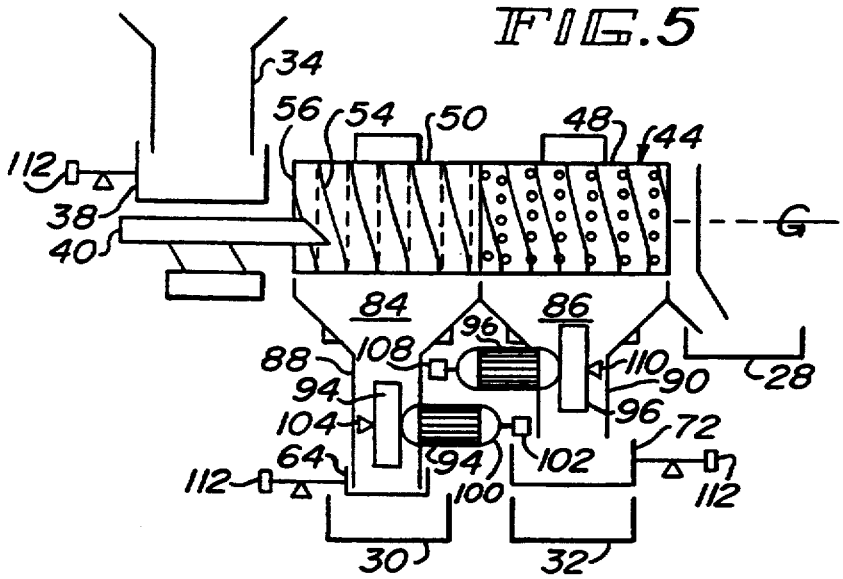
FIG. 5 is a rear schematic view, partially in cross-section, of the embodiment of the apparatus in FIG. 3.

Referring to FIG. 2, the feed hopper 34 is adapted to receive a test sample of impure grain. The feed hopper 34 including a door 36 will channel the test sample into a weighing hopper 38 which is also known as a load cell which transmits the weight of the test sample for processing in a microprocessor unit, as will be explained later. After being weighed, the test sample is unloaded on a vibrating member 40 which directs the sample into the input end 42 of a rotatable sieve cylinder 44 which has a pair of sieving sections 46 and 48, the sieving section 46 having fine perforations and the sieving section 48 having coarse perforations. Momentarily, attention is directed to FIG. 5 to show that the interior of the rotatable sieve cylinder 44 is provided with a spiral 54 to facilitate the movement of the test sample toward an output end 56 of the rotatable sieve cylinder 44.

Referring to FIG. 2, as the test sample travels through the sieving section 46, dust, broken grain, and undersized grain will fall through the fine perforations 50 and be directed into a column 58 which communicates with a blower 60 which blows the dust into a receptacle 62 while the separated product of broken grain and undersized grain falls into a weighing hopper 64 which dumps the separated product into the broken grain drawer 30. The remaining portion of the test sample moves through the sieving section 48 and most of it passes through the coarse perforations 52 into a column 66 communicating with a blower 68 which blows anything lighter than good grain into a receptacle 70 while the good grain is channeled to the weighing hopper 72. After the weighing is completed, the weight information is transmitted to a microprocessor 73, and the grain is dumped into the good grain drawer 32. Anything remaining in the rotatable sieve cylinder 44 exits out of the output end 56 and is received by the trash drawer 28.

As shown in FIG. 3, the sieve cylinder 44 is rotatably supported on four drive rollers. One of the rollers 76 is rotated by a gear 79 coupled to a motor 78 which is controlled by a controller 80. The rotational speed of the roller 76 is monitored by a tachometer 82 which provides a rotational signal output fed to the microprocessor 73, which is connected to the controller 80, as will be explained later. A tachometer 82 can be positioned on anyone of the four rollers 76. If positioned on a non-motorized roller, it can allow to detect the absence of the sieve cylinder, a bad positioning of this cylinder, or eventually skating of the cylinder. Under each sieving section 46 and 48, a duct funnel 84 and 86, respectively, is provided, to channel the sieved product into an evacuation circuit in the form of an inclined duct 88 and 90, respectively. The ducts 88 and 90 communicate with a duct, such as duct 92 coupled to the inclined duct 90 as shown in FIG. 4. The inclined ducts 88 and 90 are associated with respective blowers 94 and 96. The junction between the ducts, such as 92 and the respective inclined duct 90, contains a wire mesh 98 as shown in FIG. 4. The blower 94 is actuated by a motor 100 which is controlled by a controller 102. The speed of the blower 94 is measured by a tachometer 104 which, as mentioned before, transmits a measurement signal to the microprocessor 73. Similarly, the blower 96 is actuated by a motor 106 which is controlled by a controller 108, the speed of the blower 96 being read by a tachometer 110 which provides a speed input signal to the microprocessor 73. Each of the weighing hoppers 38, 64, and 72 is provided with a lockdown device 112.

The inclined ducts 88 and 90 communicate with densimetric sifting columns 114 and 116, respectively. Densimetric column 114 communicates with a decompression chamber 118, and densimetric column 116, communicates with a decompression chamber 120. The decompression chambers 118 and 120 are of the mesh type to allow pulsating air to escape. For example, mesh netting in the decompression chamber 118 may be coarse as opposed to the mesh netting in the decompression chamber 120. Below the decompression chamber 118, a recovery receptacle 122 is provided. A recovery receptacle 124 is provided for the decompression chamber 120.

The control circuit in the microprocessor registers the weighing of the gross weight of the test sample and subsequently actuates the weighing hopper 38 to release the test sample on the vibrating member 40 which directs the test sample into the rotatable sieve cylinder 44 in which the spiral 54 propels the test sample along the longitudinal axis of the sieve cylinder 44.

As previously mentioned, as shown in FIGS. 3 and 4, the perforations 50 in the sieving section 46 are smaller than the perforations in the sieving section 48. In this manner, a mixture of dust and broken grain or small grains will pass through the perforations of sieving section 50 and will fall into the duct funnel 84 which will guide the mixture into the inclined duct 88. At the lower end of the densimetrical column 116, the grain mixture follows its way to the drawer 30 via the weighing hopper 64, while dust is blown by the blower 94 along the densimetric column 116 and comes to rest in the recovery receptacle 124.

In a similar manner, the remainder of the test sample is moved along the sieving section 48, and the particles that fall through the coarse perforations 52, such particles being medium-sized impurities and good grain, are guided by the duct funnel 86 into the inclined duct 90. At the lower end of the densimetrical column 114, the heavier good grain follows its way into the good grain drawer 32, via the weighing hopper 72 which, before opening, weighs the good grain and transmits the weight to be registered in the microprocessor. In the meantime, the medium-sized impurities are blown by the blower 96 into the decompression chamber 118 and deposited in the recovery receptacle 122.

As for the larger impurities still present in the rotating cylindrical sieve cylinder 44, they are propelled out of the output end 56 of the sieve cylinder and fall into the trash drawer 28. In view of the use of several weighing hoppers, it is possible to calculate with suitable electronic circuits, the weights and percentages of the good grain as well as of the impurities present in the test sample. Moreover, the contents of the recovery receptacles and the drawers can be examined and then eventually, manually or automatically, transferred to other instruments or apparatus for conducting other tests, such as determining the moisture content of the grain.

As was previously mentioned, motorized potentiometers are used for setting the air velocity in the two densimetric columns 114 and 116, and also for setting the rotational speed of the rotatable sieve cylinder 44. Such a motorized potentiometer is illustrated and incorporated in a rotation control circuit 126 shown in FIG. 6 wherein the rotation control circuit is entirely supported on a base 128. The base 128 supports a motor 130 having an upwardly directed shaft 132 to which is secured a pulley 134 which is engaged by a belt 136 coupled to a pulley 138 securely mounted on a shaft 140 which has an upper end terminating in a knob 142, the other end being coupled to a rotor (not shown) inside a potentiometer 144 which is secured to the base 128 and which has a connector 146 connected to a power source for driving the motor. A coded disc 148 is mounted on the shaft 140 and is free to rotatably move between optical heads 150 and 152, the optical head 150 functioning as a receiving element, and the other optical head 152 functioning as an emitting element, both of the foregoing being connected (not shown) to a circuit board 154 having electrical components for processing the information received from optical head 150. The circuit board 154 is connected to a control circuit in the electronic part of the equipment.

The tachometers 82, 104, and 110 may be used separately or in conjunction with the rotation control circuits (motorized potentiometers) in order to determine the actual value of the rotational speeds of the two blowers 94 and 96 and the rotational speed of the roller 76 or anything else supporting the rotatable sieve cylinder 44. The tachometers are implemented to provide inputs that are processed by the main microprocessor to provide control signals for controlling the rotational speeds of the blowers and the rotatable sieve cylinder. The tachometers 82, 104, and 110 are electromagnetic sensors which generate outputs i the form of pulses each time a metallic portion of the rotating blowers are rotatable sieve cylinder registers a particular movement. For example, the tachometer 104 is installed in close proximity to the blades of the blower 94, and the tachometer 82 detects the teeth of a motor wheel which drives the rotatable sieve cylinder 44. In turn, the pulse frequencies generated by the tachometers are measured by the microprocessor.

As described previously, remote control possibilities are possible with the present invention using hardware and software having similar capabilities to that used in the NSA system. On the basis that air velocity is correlated to blower speed, the blower frequency is an absolute representative function of the air flow. As a result, different units of the present invention located in different places may be remotely programmed from one site by a computer because of the speed which is measured on a master CPU which serves as a reference. The blower speed and the speed of the rotation sieve cylinder have to be the same for a particular grain on every unit of the present invention.

Figure 8A:
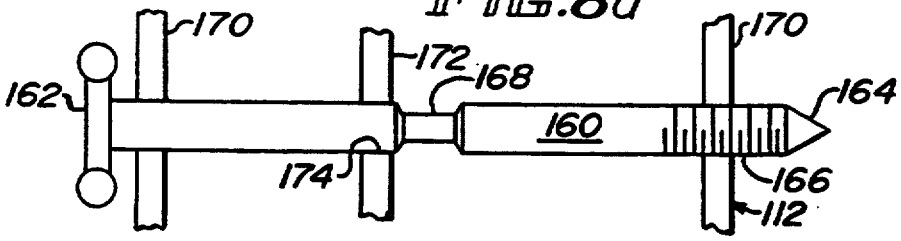
FIGS. 8*a–b* is a simplified view of a lock-down device to immobilize a weighing hopper used in the embodiment of the grain processor of FIG. 1 during transport.
Figure 8B:
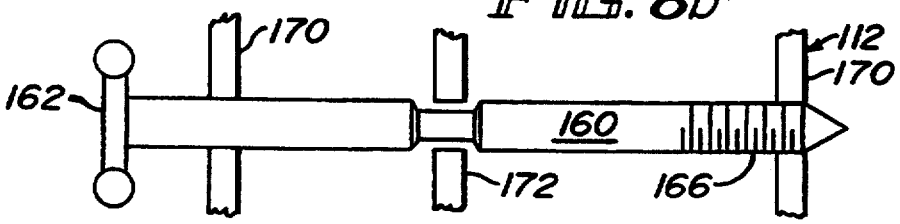

The lock-down devices 112 are used to immobilize the weighing hoppers 38, 64, and 72 whenever the weighing hoppers are not in use. The lock-down device 112 comprises an elongated member 160, as shown in FIG. 8, having at one end a knob 162, the other end of the member 160 having a threaded portion 166 terminating in a conical point 164. Approximately mid-point of the elongated member 160 is a wide groove 168. The elongated member 160 is supported at both ends by portions of a housing 170. Each of the weighing hoppers, such as hopper 38, has a top-extending portion 172 provided with an aperture 174 through which the elongated member 160 passes. As shown in FIG. 8-*a*, the elongated member 160, at its greatest diameter, supports the weighing hopper in a locked position when the knob 162 is sufficiently turned clockwise so that the conical point 164 extends substantially past the portion of the housing 170. When it is desired to use the weighing hopper, the knob 162, as shown in FIG. **8-*b*, is turned counterclockwise until the groove 168 is aligned with the top-extending portion 172**, thereby freeing the weighing hopper for vertical movement.

Figure 9:
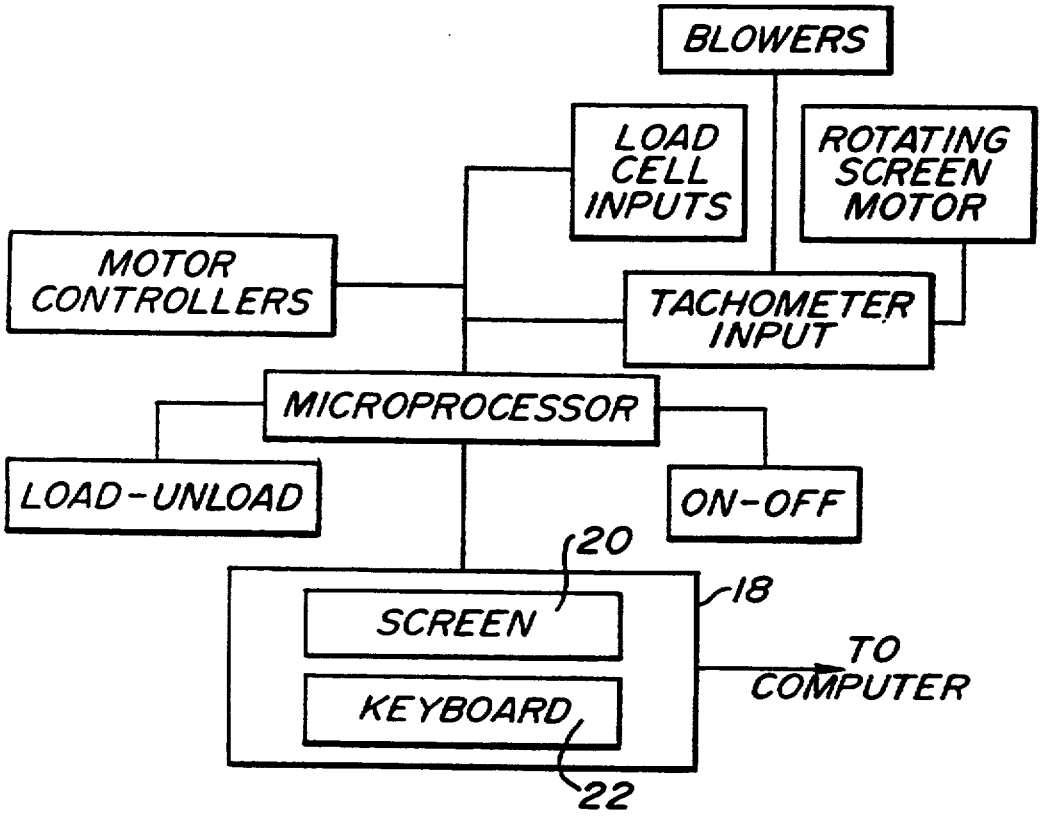
FIG. 9 is a simplified block diagram showing the overall arrangement of the components illustrated in FIGS. 1–6.

FIG. 9 is a simplified block diagram of the various components comprising the grain processor apparatus. As shown in an enlarged illustration, the console 18 has the display screen 20 and a keyboard 22. Although the grain processor 10 can be used independently of any other equipment, as previously explained, a number of such grain processors can be networked together to a main control at a headquarters of a farm agency provided with a computer processing unit (CPU).

Figure 6:
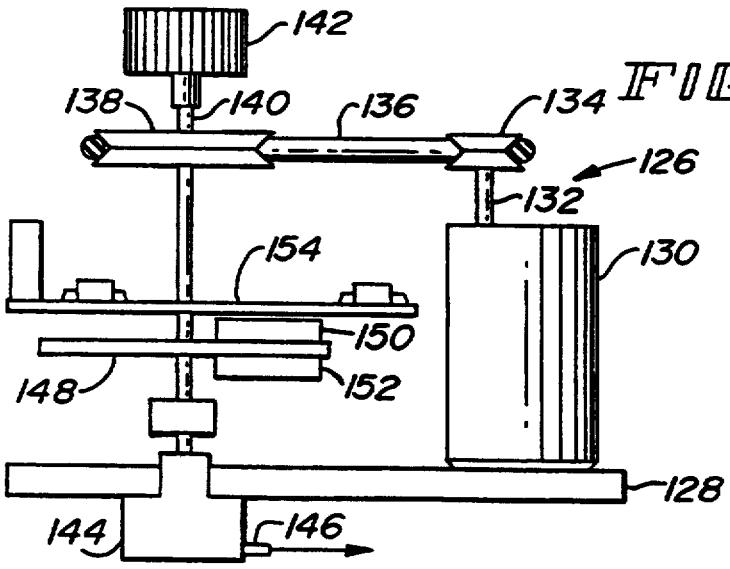
FIG. 6 is an elevation view of a motorized potentiometer to provide inputs for controlling rotational speeds of blowers and/or a rotary sieve in the embodiment of the grain processor of FIG. 1.

Although a motorized potentiometer using a variable resistor has been described as being used in the rotation control circuit 126 shown in FIG. 6, it is possible to use variable inductive or capacitative components instead of a resistive component.

Figure 7:
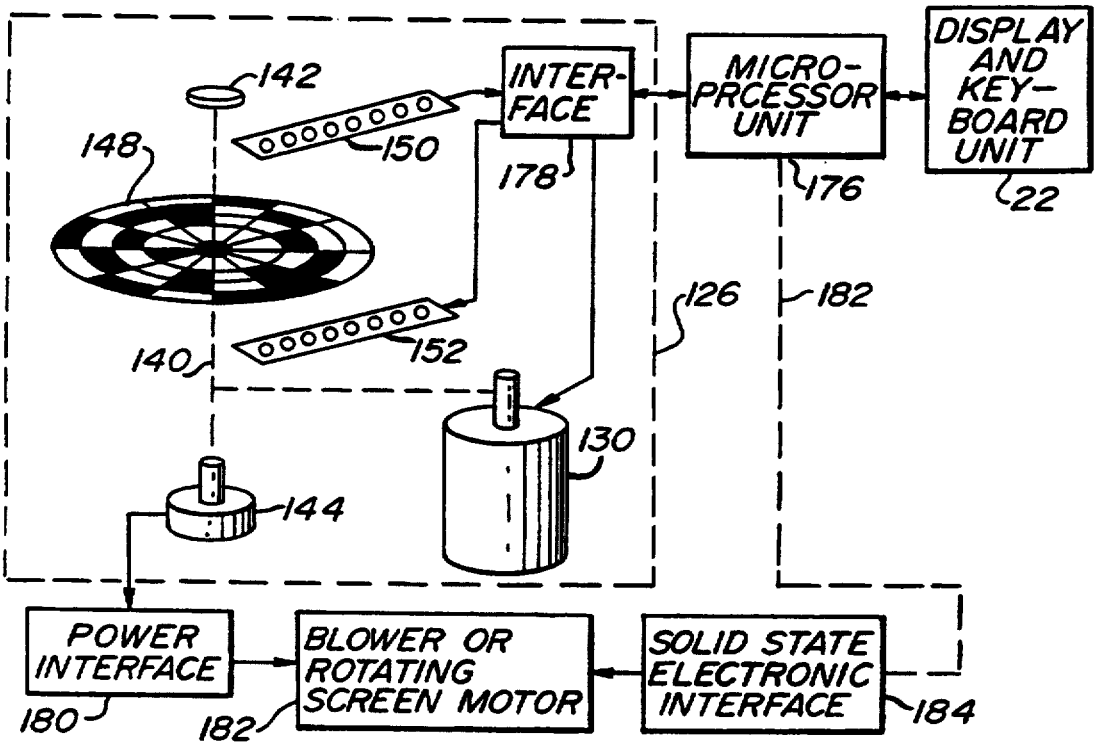
FIG. 7 is another schematic view of the motorized potentiometer shown in FIG. 6.

The rotation control circuit 126 shown in FIG. 6 is shown in a greater detail in FIG. 7 wherein an optically-coded disc 148 has eight tracks divided into 180 sectors of 2° each. For simplicity, only four tracks are shown. The optical head 150 has eight light-receiving diodes, and the optical head 152 has eight light-emitting diodes for reading the actual angular position of the potentiometer 144. The rotation control circuit 126 is connected to a microprocessor unit 176 which, in turn, is connected to the display and keyboard unit 22. The optical heads 150 and 152, as well as the motor 130, are coupled to the microprocessor unit 176 by an interface 178. The output of the potentiometer 144 is connected to a power interface 180 which supplies power input to the block 182 containing motors which operate the blowers 94, 96 and the rotating sieve cylinder 44.

There will now be described the process of setting up the apparatus for separating a test sample containing grain and impurities.

The measuring cycles can be:

learning cycles, operating cycles.

During a learning cycle (CONTROL key), the operator can move manually the knob 142 of each potentiometer in order to obtain the correct speed for each blower and for the rotating screen.

At the end of the learning cycle, the actual position of each potentiometer, represented by the actual optical coding read on the respective disc, is stored in the computer memory by the microprocessor.

If the operator decides to make consecutive learning tests, new settings are stored in place of the preceding ones at the end of each cycle.

The learning cycles are continued by the operator until it is established what rotational speeds of the blower motors and the sieve cylinder motor are best for extracting the optimum amount of good grain in a given time.

During the operating cycle (START key), the microprocessor reads the settings corresponding to the selected grain in the computer memory, and turns each potentiometer until its position (angular coding) is in accordance with the setting.

This movement of the potentiometer is realized by the electric motor 130 which is driven by the microprocessor.

As a further modification of the embodiment shown in FIG. 7, the microprocessor 176 may be connected by a line 182 to a solid-state electronic interface 184 for providing power to the electric motors found in block 182. In this case, the motorized potentiometers are replaced by up-and-down arrows 186 on the keyboard 22, as shown in FIG. 10.

Figure 10:
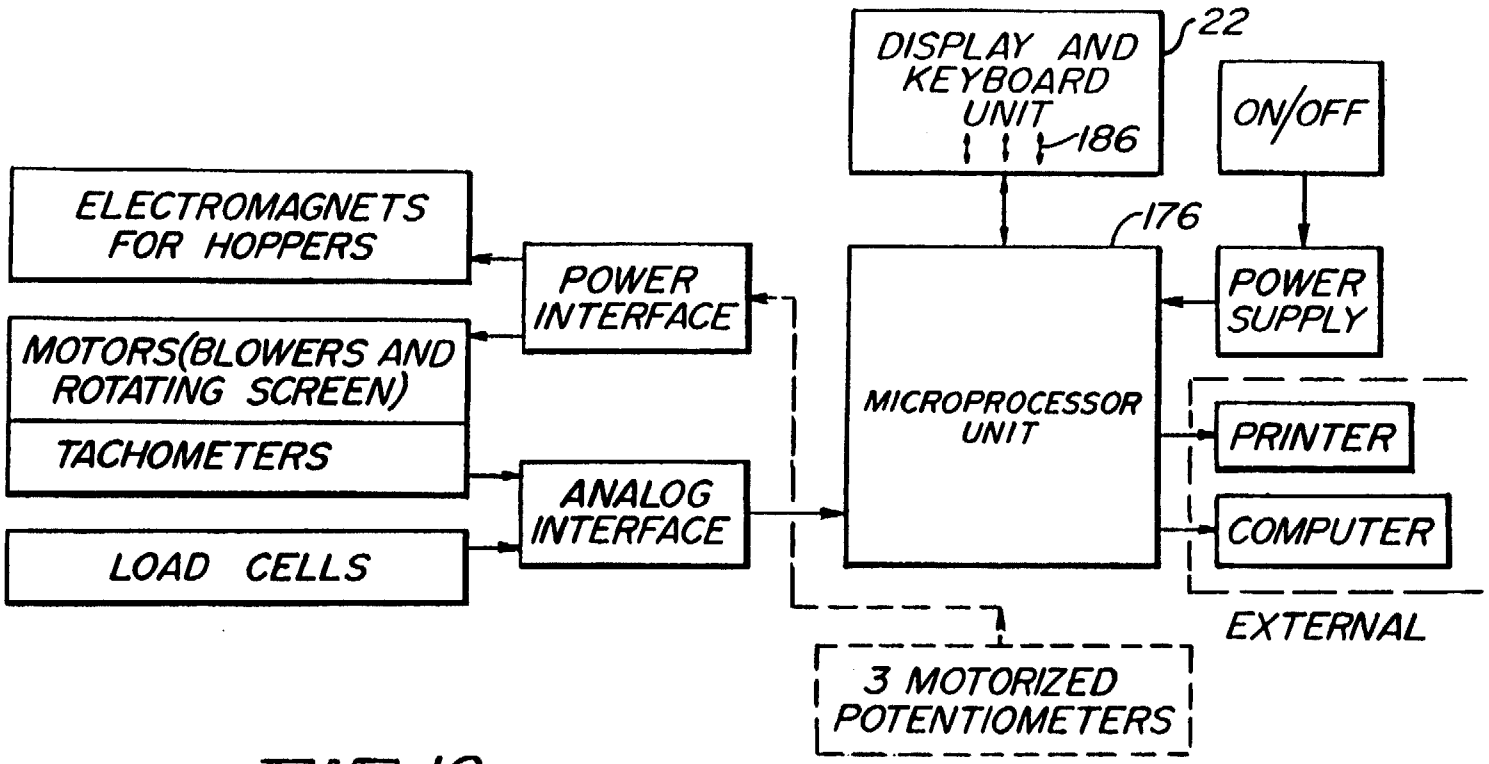
FIG. 10 is a simplified block diagram showing a modification of the overall arrangement shown in FIG. 9.

The simplified block diagram shown in FIG. 9 can be embellished with additional electronic structure using the rotation control circuits 126, as shown in greater detail in FIG. 10.

Figure 12:
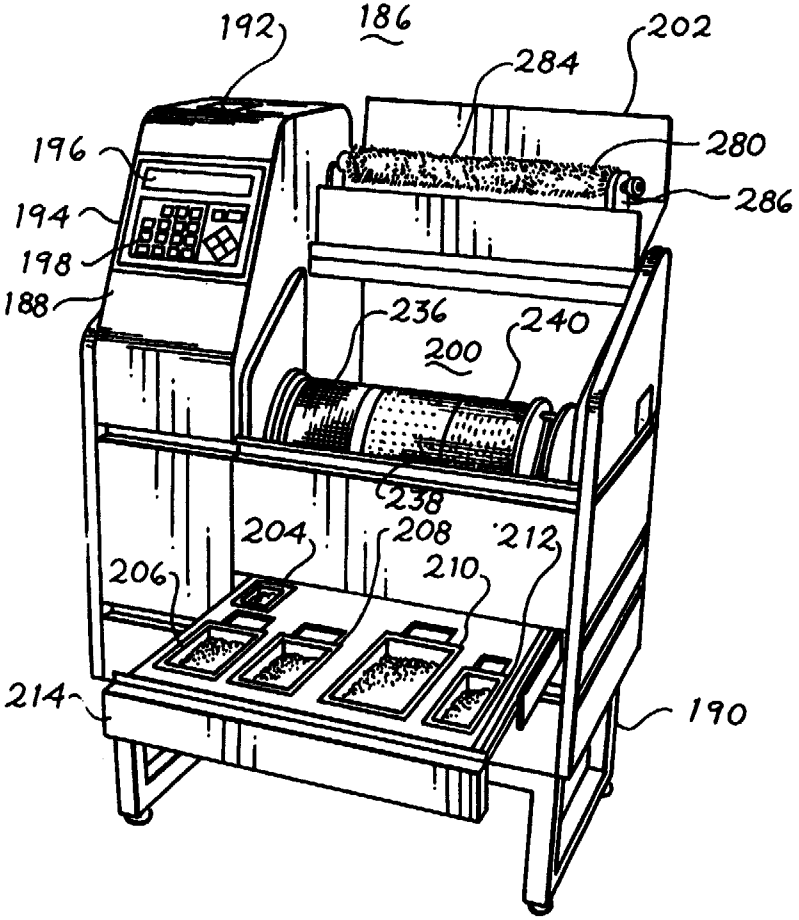
FIG. 12 is a front view of the second embodiment of FIG. 11 when opened so as to expose the interior.
Figure 11:
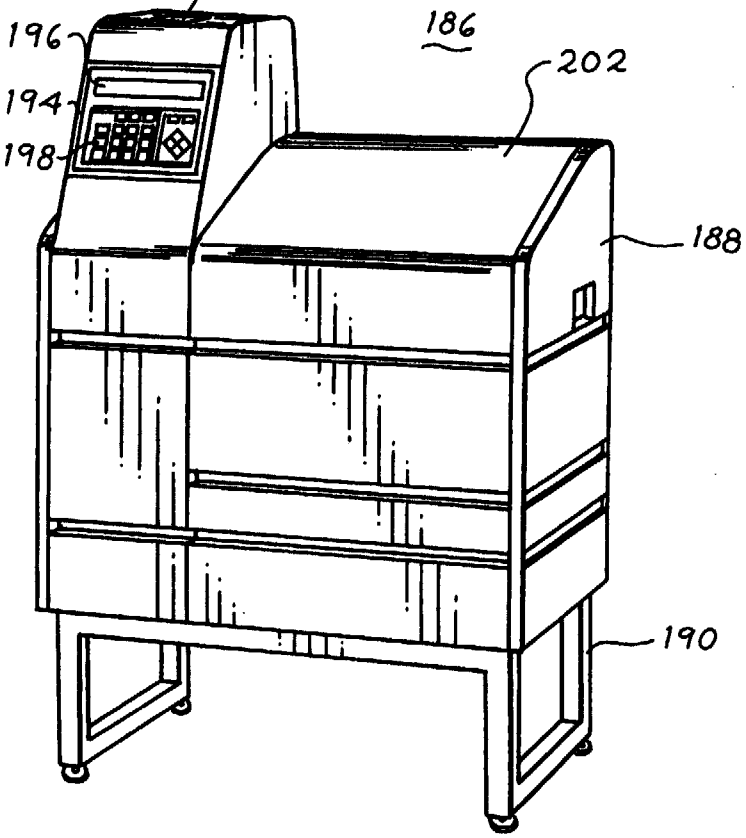
FIG. 11 is a perspective view of a second embodiment of the present invention.

FIGS. 11–19 show a second embodiment of a grain processor. As shown in FIG. 11, grain processor 186 comprises a cabinet 188 supported on a stand 190. Grain processor 186 has a feed hopper opening 192 to receive an adequate quantity of a test sample of grain. Adjacent hopper opening 192 is a console 194 provided with a display screen 196 and a keyboard 198. As will be described later, the test sample of grain is separated in part by a rotary sieve 200. Access to rotary sieve 200 is accomplished by opening upper portion 202 as shown in FIG. 12. Once upper portion 202 is opened the rotary sieve 200 can be changed depending on the type of grain to be analyzed. The grain processor 186 separates the grain into five components: (1) aspirated particles received by an aspiration system; (2) first screen dockage; (3) second screen dockage; (4) whole grain; and (5) gross particles, which passes through the rotary sieve. These five components are received in corresponding receiving receptacles 204, 206, 208, 210, and 212 which are contained in removable drawer 214, as seen in FIGS. 12–15 and 18.

Figure 14:
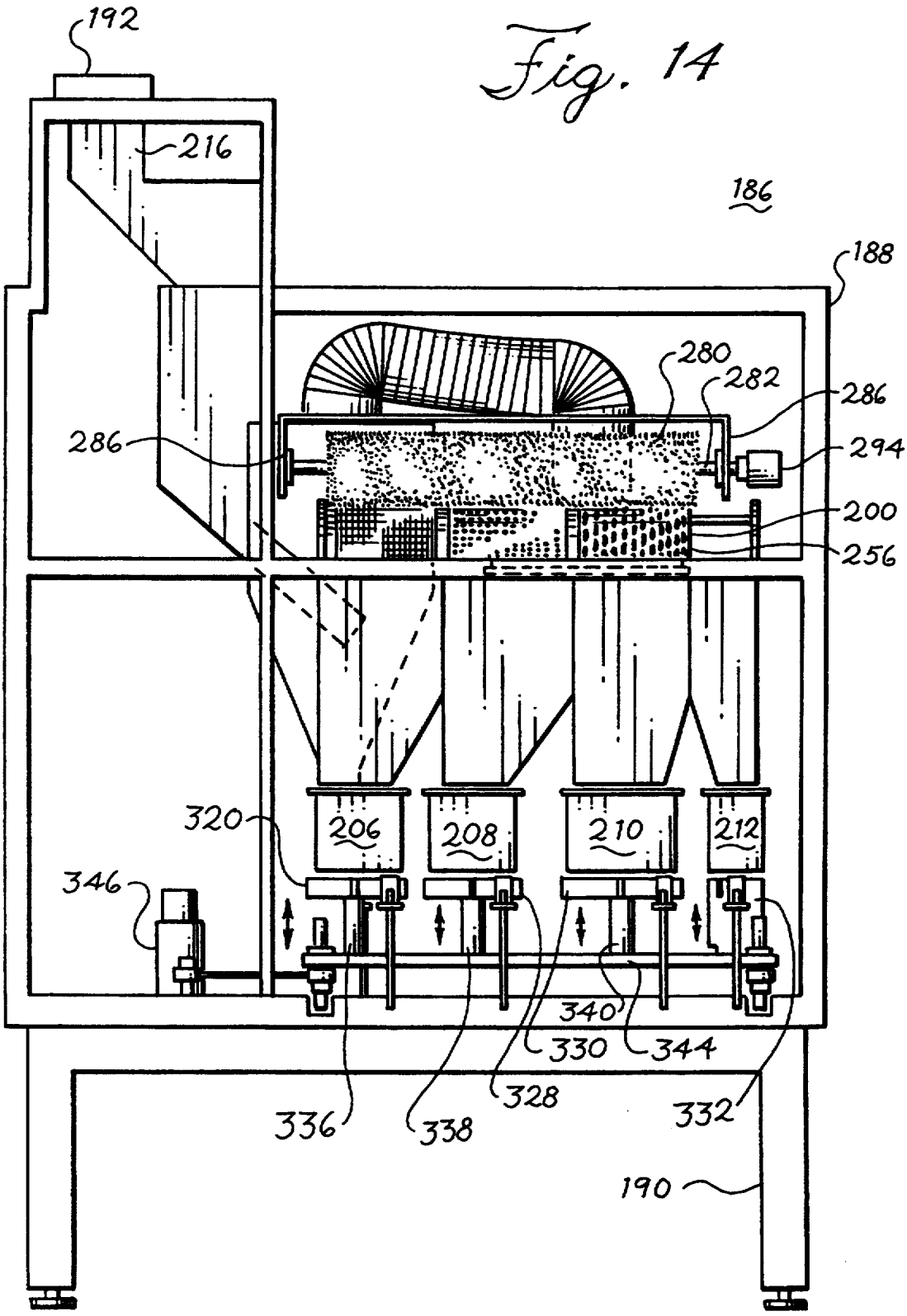
FIG. 14 is a front cutaway view of the interior of the second embodiment of FIG. 11.
Figure 15:
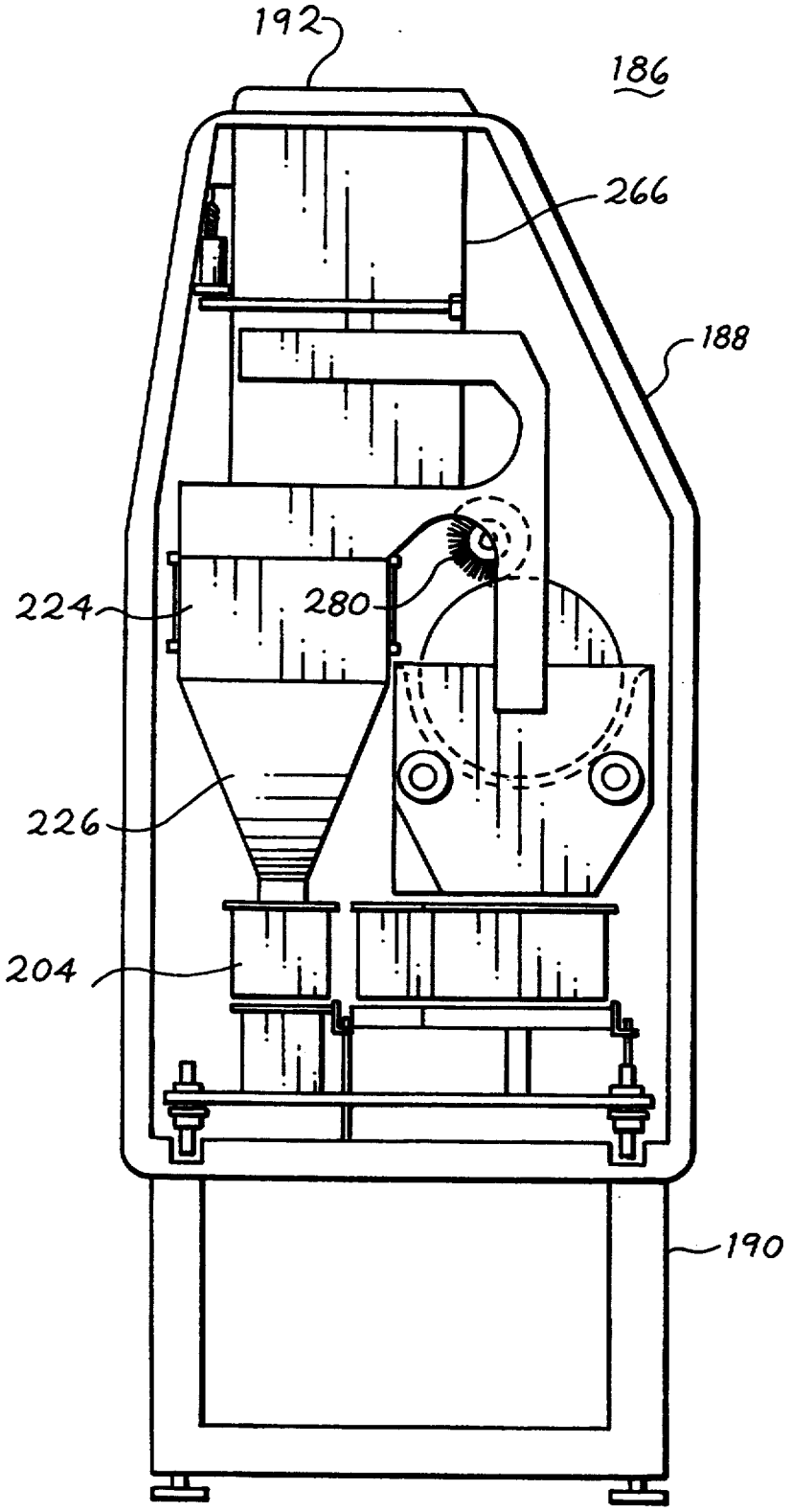
FIG. 15 is a side cutaway view of the interior of the second embodiment of FIG. 11.
Figure 18:
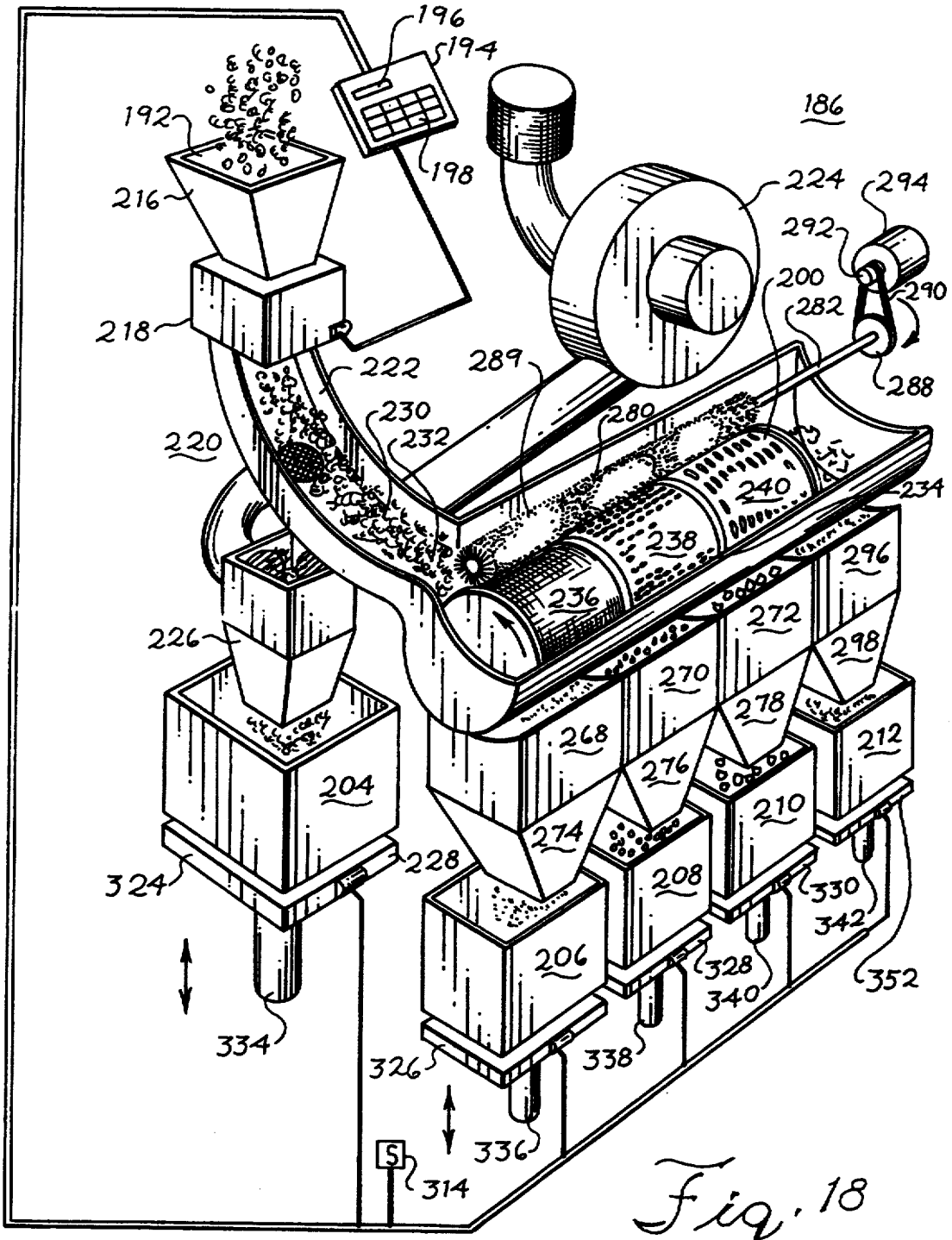
FIG. 18 is a schematic drawing of the second embodiment of FIG. 11.

The separation of the five components is accomplished by pouring the test sample of impure grain into feed hopper opening 192. As shown in FIGS. 14, 15, and 18, the grain is directed by hopper funnel 216 into the grain processor 186. To gain access to the inside of the grain processor 186, the grain is dropped directly into a feed hopper 218 having a weighing sensor which transmits a signal representing the gross weight of the test sample for processing in a microprocessor unit. In another embodiment, it is contemplated that a hopper funnel would not be needed. In such an embodiment, the test sample is directly deposited into the hopper 218 from opening 192.

After being weighed, the test sample is unloaded on a feeding member (not shown), such as the vibrating member disclosed in the first embodiment or a belt feeder. A sensor is provided for measuring the feed rate and to insure a consistent feed rate of the test sample into the grain processor. For example, an accelerometer is used to measure the feed rate when a vibrating member is used and a tachometer is used to measure the feed rate when a belt feeder is employed. The feeding member directs the sample into an aspiration system 220.

Aspiration system 220 comprises a passage 222 to receive the grain from the feeding member. By the force of gravity the grain flows down passage 222 causing light particles to float in the passage 222. To remove the light particles a vacuum source 224 is connected to the passage 222 to produce a sub-atmospheric pressure sufficient to remove the light particles. The light particles removed are directed by a column 226 to a receiving receptacle 204, which can be connected to a weighing sensor 228. Sensor 228 produces a signal representative of the weight of the light particles in the receiving receptacle 204 and which signal is sent to a microprocessor. The vacuum source 224 employs a motor which produces a range of pressures by generating rotational speeds ranging from approximately 15 to 60 (measurement of number of vacuum source blades measured per a unit time), wherein the desired pressure and rotational speed depends on the spectrum of grains being analyzed. Note that a speed sensor may be employed with the vacuum source to measure the rotational speed of the motor of the vacuum source 224. An example of a vacuum source is a 110 V, 0.2 HP, totally enclosed non-ventilated motor, such as available from Dumore Corp. as Ser. No. 3445-510; SP 5339. Furthermore, a 5" centrifugal blower (such as available from Jan Air, wheel #SF0500200IRC, housing #SH0500325FEE) is attached to the cyclone via a 3' long 3.5" interior diameter fiberglass flexible duct.

The rest of the grain sample is directed from the passage 222 to a second passage 230 connected to the input end 232 of a rotary sieve 200. Rotary sieve 200 comprises a cylinder 234 with three sieving sections 236, 238, and 240, as shown in FIGS. 12, 16, 17, and 18. Sieving section 236 has a screen 242 with fine perforations, sieving section 238 has a screen 244 with medium sized perforations, and sieving section 240 has a screen 246 with coarse perforations. The perforations may have many shapes, such as being round, slotted, or triangular. The size of the perforations also will vary depending on the type of grain analyzed as shown by the table below:

| GRAIN | S1 | S2 | S3 | FEED RATE | AIR SPEED | SIEVE SPEED | SIEVING TIME TIME(S) | JINK TIME(S) |
|---|---|---|---|---|---|---|---|---|
| RED SPRING | 5Δ | 5Δ | WO | 30 | 25 | 60 | 160 | 1 |
| DURUM | 5.5Δ | 5.5Δ | WO | 30 | 25 | 65 | 160 | 1 |
| BARLEY | 5.0Δ | 5.5Δ | 9.0S | 30 | 38 | 80 | 140 | 1 |
| OATS | 5.0Δ | 5.5Δ | 8.0S | 45 | 30 | 80 | 145 | 1 |
| BARLEY SIZING (250 GMS) | 5.0S | 6.0S | 9.0S | 30 | 00 | 60 | 60 | 0 |
| BUCKWHEAT | 7.0S | 7.5S | 16.0R | 40 | 40 | 75 | 140 | 2 |
| LENTILS LARGE | 12R | 12R | 20R | 30 | 60 | 65 | 140 | 1.5 |
| LENTILS SMALL | 5.5R | 9.0R | 14R | 40 | 60 | 75 | 140 | 1.5 |
| SUNFLOWER SEEDS | 10R | 10R | 16S | 40 | 50 | 85 | 140 | 1.0 |
| CANOLA | 03.5S | 3.5S | 6.25R | 30 | 30 | 70 | 170 | 3.5 |
| SOYBEANS | 8.OR | 9.OS | 20R | 35 | 30 | 50 | 100 | 0 |
| PEAS | 6Δ | 11S | 20R | 35 | 30 | 50 | 110 | 0 |
| BROWN MUSTARD | 32S | 32S | 5.0R | 30 | 20 | 70 | 135 | 1.5 |
| YELLOW MUSTARD | 37S | 37S | 6.5R | 30 | 20 | 70 | 130 | 1.5 |
| SPEC. CLEANING | 4.5R | 40S | 6.5R | 22 | 15 | 80 | 200 | 1.8 |
| ORIENTAL MUSTARD | 32S | 32S | 5.0R | 22 | 15 | 80 | 180 | 1.2 |
| CANARY SEED | 4.5 | 4.5 | 4.0S | 25 | 40 | 60 | 150 | 2.0 |
| FLAXSEED | 5.0R | 5.0R | 4.0S | 25 | 25 | 70 | 150 | 2.0 |
| RYE | 5.0Δ | 5.5Δ | W/O | 20 | 25 | 60 | 170 | 1.0 |

In the above table, the columns S1, S2, and S3 provide the size and shape of the perforations for sieving sections 236, 238, and 240, respectively. In each of the S1, S2, and S3 columns, the symbols Δ, S, and R represent the shape of the perforations. For example, Δ denotes a perforation or opening in the shape of an isosceles triangle; S, a slotted or oblong perforation having a length of approximately 0.75"; and R, a round perforation. The values in the columns give the size of the perforations measured in units of 1/64". Thus, for soybeans the perforations for sieving sections 236 and 240 are each round and have a diameter of approximately 8/64" and 20/64", respectively. In addition, sieving section 238 has slotted perforations having a length of approximately 0.75" and a width of approximately 9/64". The triangular perforation values represent the length of the sides of the isosceles triangle in units of 1/64". The term WO refers to replacing sieving section 240 with the wild oat sieving section to be described later.

The column Feed Rate provides the approximate feed rates of the feeding member by measuring the number of counts per unit time generated by a component of the system and measured by a sensor, such as the shaft of the belt. The column Air Speed provides the approximate speed of the rotating blades of the vacuum source by providing the number of blades counted by a sensor per unit time. In addition, the Sieve Speed column provides the approximate rotational speed of each of the sieving sections by measuring the number of counts per unit time generated by a component of the system, such as a shaft, and measured by a sensor. The Sieving Time column provides the time in seconds for sieving a 1200 gram sample.

Figure 17:
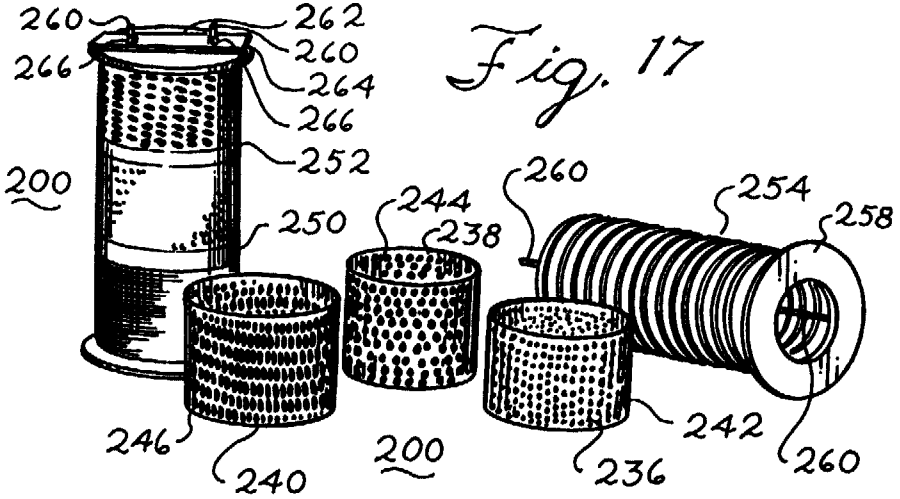
FIG. 17 is an exploded view of the screen of FIG. 16.
Figure 19:
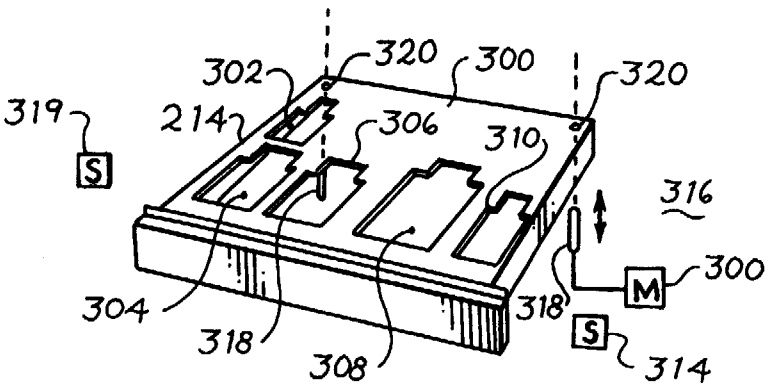
FIG. 19 is a schematic drawing of a locking mechanism used on the drawer of FIG. 13.
Figure 13:
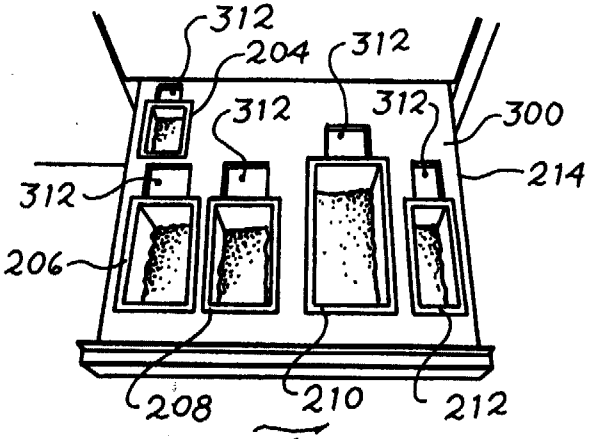
FIG. 13 is a top view of the drawer of the second embodiment of FIG. 11 in an opened position.
Figure 16:
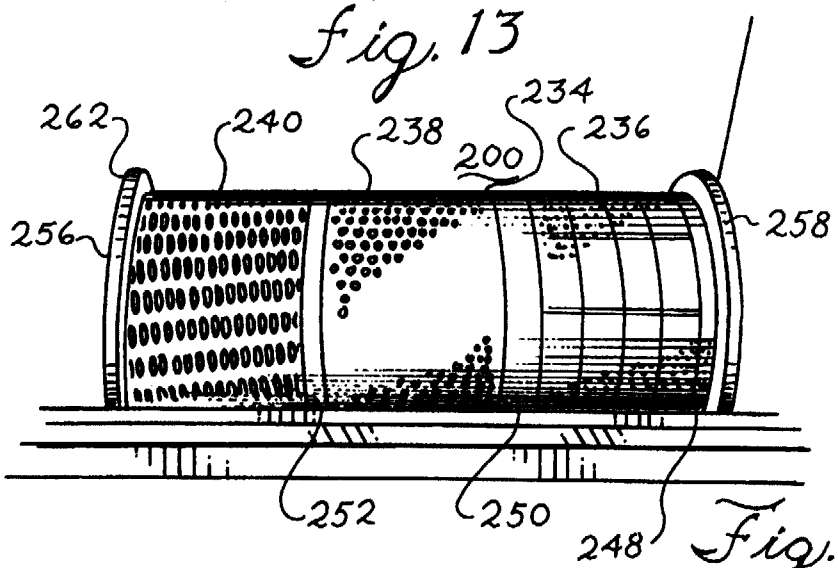
FIG. 16 is a view of a cylindrical screen used in the second embodiment of FIG. 11.

Sieving sections 236, 238, and 240 are separate components made of steel or aluminum, have a diameter of approximately 8" and a screen length of approximately 5". At an end of each screen 242, 244, and 246 are attached bands 248, 250, and 252, respectively. Bands 248, 250, and 252 allow for the attachment of adjacent sieving sections by having the screen of one sieving section snugly fit inside the band of an adjacent sieving section, as shown in FIGS. 16 and 17. Thus, the sieving sections are easily interchangeable.

Rotary sieve 200 is provided with a spiral 254 to facilitate the movement of the test sample toward an output end 256 of the rotary sieve 200. Spiral 254 is attached to a first annular piece 258 via being welded to two rods 260 axially extending from annular piece 258. The three sieving sections are placed over the spiral 254 and attached to the annular piece 258 through band 248 of screen 242. A second annular piece 262 is placed on the edge of screen 246 and clamped into place by bar 264 positioned on top of annular piece 262, as shown in FIG. 17. Bar 264 has two holes wherein the two rods 260 go through and nuts 266 are threaded on the rods 260 and tightened against bar 264.

Once assembled, rotary sieve 200 is placed in the grain processor 186 to be rotated when the grain sample enters the rotary sieve 200 resulting of the test sample into several components. Rotary sieve 200 is controlled by a drive mechanism, rotational speed control, and sensor for sensing the presence and the speed of the rotary sieve 200 as described for the first embodiment of the grain processor and shown in FIGS. 3, 6, and 7.

It is possible to program various rotational sequences for the rotary sieve 200. For example, a sequence referred to as jinking can be programmed. Jinking involves running the auger in a plurality of cycles. Each cycle comprises an initial phase occurring at the beginning of the cycle and a jinking phase occurring at the end of the initial phase and extending to the end of the cycle. In the initial phase, the auger runs in the forward direction at a programmed speed for a fixed time period. The fixed time period may be constant for all types of grains analyzed. At the end of the initial phase, the jinking phase begins in which the auger is reversed in direction at full speed for a fixed amount of time (jinking time) dependent on the type of grain being analyzed. The jinking times for various grains were given in Table I previously. Once a cycle is complete the process is repeated until the sieving time given in Table I is complete. Note that if the jinking time is set to be 0 seconds, the auger stops instantaneously rather than reversing in direction.

Under each sieving section 236, 238, and 240, a corresponding column 268, 270, 272, respectively, is provided, to channel the sieved product into funnels or channels 274, 276, and 278, respectively. Thus, as the test sample travels through the sieving section 236, broken grain, and undersized grain will fall through screen and be directed into a channel 274 which communicates with a receiving receptacle 206. The remaining sample of grain moves to sieving section 238 in which larger, but still broken grain and undersized grain, will fall through and be directed to a channel 276 and a receiving receptacle 208. The sample of grain remaining in rotary sieve 200 then moves to third sieving section 240 wherein acceptable whole grain falls through and is directed to a receiving receptacle 210 via channel 278.

Should any grain become stuck in the perforations of sieving sections 236, 238, and 240 a dislodgment device, such As brush 280, makes contact with the stuck grain and dislodges them. As shown in FIGS. 12, 14, and 18, brush 280 comprises a rod 282 to which bristles 284 are attached. Ends of rod 282 are attached to supports 286 allowing for rotation of brush 280 about an axis. One end of rod 282 is attached to a pulley 288 which in turn is connected to a drive belt 290 attached to a drive shaft 292 of a single speed motor 294. Thus, when motor 294 is activated by the microprocessor the brush 280 rotates.

As for the larger impurities still present in the rotary sieve 200, they are propelled out of the output end 256 of the sieve cylinder. The larger impurities are collected in column 296 and are directed into funnel or channel 298 and fall into the receiving receptacle 212. Thus, the capture of five components of the grain in receiving receptacles is accomplished. Receiving receptacles 204, 206, 208, 210, and 212 are each located in a drawer 214 which comprises a horizontal surface 300 made of steel, aluminum, or anti-static plastic and has corresponding openings 302, 304, 306, 308, and 310 to receive each receiving receptacle. Each of the openings include offset openings 312 which allow a person's hand to be inserted therein allowing for easy removal of the receiving receptacles from the openings. Drawer 214 slidably moves from a closed position wherein it receives the grain to an open position where the receiving receptacles can be removed. There is a sensor 314 schematically shown in FIGS. 18 and 19 which sends a signal to a microprocessor (not shown) located in the console 194 indicating whether the drawer is in the closed or opened position. Sensor 314 may be either an electro-optical or electro-magnetic sensor which are well known in the art. In response to the signal, the microprocessor creates a signal preventing the grain processor 186 from operating when the drawer 214 is in the open position. In the closed position and during operation of the grain processor, the microprocessor sends a signal to a locking device 316 schematically shown in FIG. 19 to lock drawer 214 in position. The locking of the drawer 214 is accomplished by having a locking element, such as pin 318, engage the drawer 214 at a mating section, such as hole 320. Pin 318 engages hole 320 by vertically moving from a non-locking position to a locking position via motor 322 in a well known manner, such as being attached to the weigh sensor support 344.

Once the drawer 214 is locked in position and receives the grain in the receiving receptacles the weighing of each component is possible. The weighing of each component may be accomplished by arranging underneath each receiving receptacle 204, 206, 208, 210, and 212 corresponding weighing platforms 324, 326, 328, 330, and 332. Each weighing platform has a corresponding weighing sensor 334, 336, 338, 340, and 342. Second sensors may also be aligned to some of the weighing platforms to measure such parameters as the moisture of the grain. Note that it is also possible to only use four weighing trays for four corresponding receptacles, since the measurements from the weighing hopper and the four weighing trays can be used to calculate the amount of the component in the fifth receptacle. Thus, only weighing sensors for receptacles 204, 206, 208, and 210 and feed hopper 218 may be needed.

Weighing platforms 324, 326, 328, 330, and 332 are each attached to a support 344 shown in FIG. 14. Support 344 via motor 346 is able to move in a vertical direction from a disengaged position wherein the weighing platforms and sensors are not in contact with the receiving receptacles to an engaged position wherein each weighing platform and sensor engages a corresponding receiving receptacle. Vertical movement of support 344 is accomplished by a single DC Gearmotor (Pittman #GM9434-38.33:1) linked to four corner drive screws via a timing belt and four timing pulleys. As the motor turns, it drives the timing belt which in turn drives the timing pulleys attached to the corner drive screws. Nuts on the drive screws, secured from rotation via tie-bars between pairs of nuts, ride up and down, depending on the direction of rotation of the drive screws. The weigh sensor support 344 rests on the screws resulting in the support 344 moving up and down with the screws.

In view of the use of several weighing hoppers, it is possible to calculate with suitable electronic circuits, the weights and percentages of the good grain as well as of the impurities present in the test sample. Moreover, the contents of the recovery receptacles and the drawers can be examined and then eventually, manually or automatically, transferred to other instruments or apparatus for conducting other tests, such as determining the moisture content of the grain.

As with the first embodiment, grain processor 186 can be networked with other such grain processors to a main control at a headquarters of a farm agency provided with a computer processing unit (CPU). Furthermore, grain processor 186 is able to have calibration and display data output to a computer or a printer.

Operation of grain processor 186 is accomplished by first initializing the machine, entering a password, and entering the initial parameters of the grain processor on the console 194. Examples of initial parameters to be entered on the display are: feed rate; aspiration speed; cylinder rotation speed; jink rate; and sieve size selection. Once the initialization of the grain processor 186 is accomplished, a sample of grain is poured into grain hopper 192 from which the five components of grain are separated into corresponding receiving receptacles as described previously. Once the original sample of grain has been separated into the five components, the microprocessor sends a signal to motor 346 resulting in support 344 and weighing sensors 334, 336, 338, 340, and 342 to disengage each corresponding receiving receptacle. Weighing sensors 334, 336, 338, 340, and 342 then send signals to microprocessor representative of the weight of each component. The signals from the weighing sensors are processed by the microprocessor so that one can call up the weight of each component or the percent of each component with respect to the starting sample weight. Furthermore, the percent of foreign material, broken grain, and total defects can also be automatically calculated and displayed.

Figures 23A, 23B, 23C:
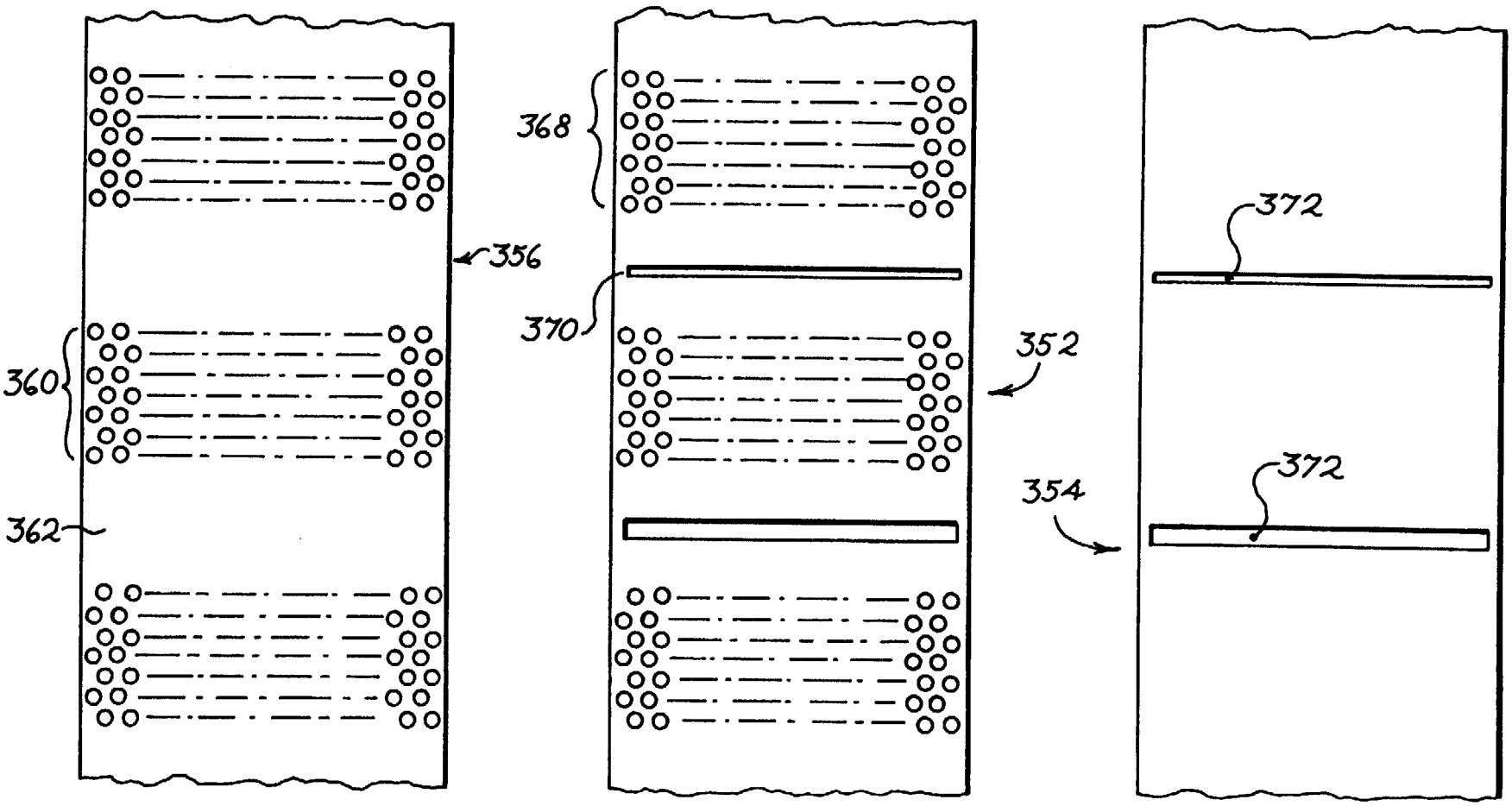
FIGS. 23A–C are views of the component screens which constitute the wheat and wild oats screen embodiment of FIG. 21.

In another embodiment of the present invention, a wild oat sieving section has been discovered which effectively separates wheat from undesired wild oat. The wild oat sieving section 348 is illustrated in FIGS. 20–23. Sieving section 348 is constructed so as to replace sieving section 240 in the grain processor 186 described previously. As shown in FIG. 20, sieving section 348 comprises a first sieving layer 350, a second sieving layer 352, and a third sieving layer 354, wherein each is made of aluminum. First sieving layer 350 is cylindrical in shape and is attached to rotary sieve 200 in a manner similar to how sieving section 240 is attached to rotary sieve 200. First sieving layer 350 comprises a screen surface 356 and two annular supports 358 which extend from the screen surface 356 by approximately 0.139". As shown in FIG. 23A, screen surface 356 comprises a number of perforated equally spaced sections 360 having a length of approximately 6.125" and a width of approximately 1.400". Each perforated section 360 is separated an adjacent unperforated section 362 by approximately 0.655". Furthermore, each perforated section 360 comprises 7 rows of openings staggered by 45° as viewed from adjacent rows. The openings of each row comprise 20 circular holes having a diameter of approximately 0.188" . and adjacent holes in a row are separated by approximately 0.19" center-to-center.

Attached to the annular supports 358 are a second sieving layer 352 and a third sieving layer 354. As shown in FIGS. 21 and 22 attachment is achieved by well known means, such as screws 364. Once sieving layers 352 and 354 are attached they and sieving layer 350 define a channel 366. As shown in FIG. 23B, second sieving layer 352 comprises 13 equally spaced perforated sections 368 wherein each perforated section 368 has a length of approximately 6.125" and a width of approximately 1,470". In one embodiment, each perforated section 368 comprises 18 rows of openings staggered by 45° as viewed from adjacent rows. In another embodiment, each perforated section 368 comprises 7 rows of openings staggered by 45° as viewed from adjacent rows so that the openings are aligned with and have a one-to-one correspondence with the openings of perforated sections 360 of screen surface 356. The openings of each row comprise 20 circular holes having a diameter of approximately 0.188" and adjacent holes in a row are separated by approximately 0.19" center-to-center. Centered between each perforated section 368 is a slot 370 having a length of approximately 4.4" and a width of approximately 0.25". As shown in FIG. 23C, third sieving layer 354 comprises slots 372 which are aligned with and have the same dimensions as slots 370. It should be denoted that other parameters such as the dimensions, the shapes of the openings, the number of openings, and the configuration of the openings are possible without straying from the spirit of the embodiment of FIGS. 20–23.

With the above description of the wheat and wild oat sieving section 348, it is possible to describe the sieving process for wheat and wild oat as shown in FIG. 22. The sieving process is based on the observation that wheat (A) and wild oat (B) kernels have different shapes. Both wheat and wild oat kernels are oval in shape, however, wheat has a rounder shape than wild oat kernels having a typical length of approximately 0.188" to 0.250" and a width of approximately 0.125". Wild oat kernels are more elongated than wheat kernels having a length of a typical length of approximately 0,350" and a width of approximately 0,100. Thus, when wheat and wild oat kernels enter sieving section 348 they each enter channel 366 since each first sieving layer comprises a plurality of openings having a size sufficient to allow the wild oat kernels and the wheat kernels to move through the openings. It should be noted that the dimensions of the wheat kernels may vary depending on the type of wheat, such as hard red summer, hard red winter, and durum. Thus, the above-given dimensions may be altered so that the wild oat sieve will operate properly for different types of wheat or wild oat.

However the first sieving layer and the second sieving layer are separated by a distance less than approximately the largest dimension of any of the wild oat kernels and greater than approximately the largest dimension of any of the wheat kernels. In other words, the separation distance is such that wheat kernel is able to "turn the corner" to wholly enter channel 366 but wild oat kernel is unable to "turn the corner." In addition, wild oat kernels become stuck in the openings of the second sieving layer. The openings of the second sieving layer are chosen to have a size sufficient to have the wild oat kernels to only partially enter and a size such that the wheat kernels are unable to enter at all. Thus, the wheat kernels are able to move down the channel 366, while the wild oat kernels become stuck in the openings. As the cylinder rotates, the wild oat kernels eventually fall back through the openings of the first sieving layer and are augered to hopper 212. Furthermore, the wheat kernels eventually fall through slits 370 and 372 into hopper 210.

Figure 24A:
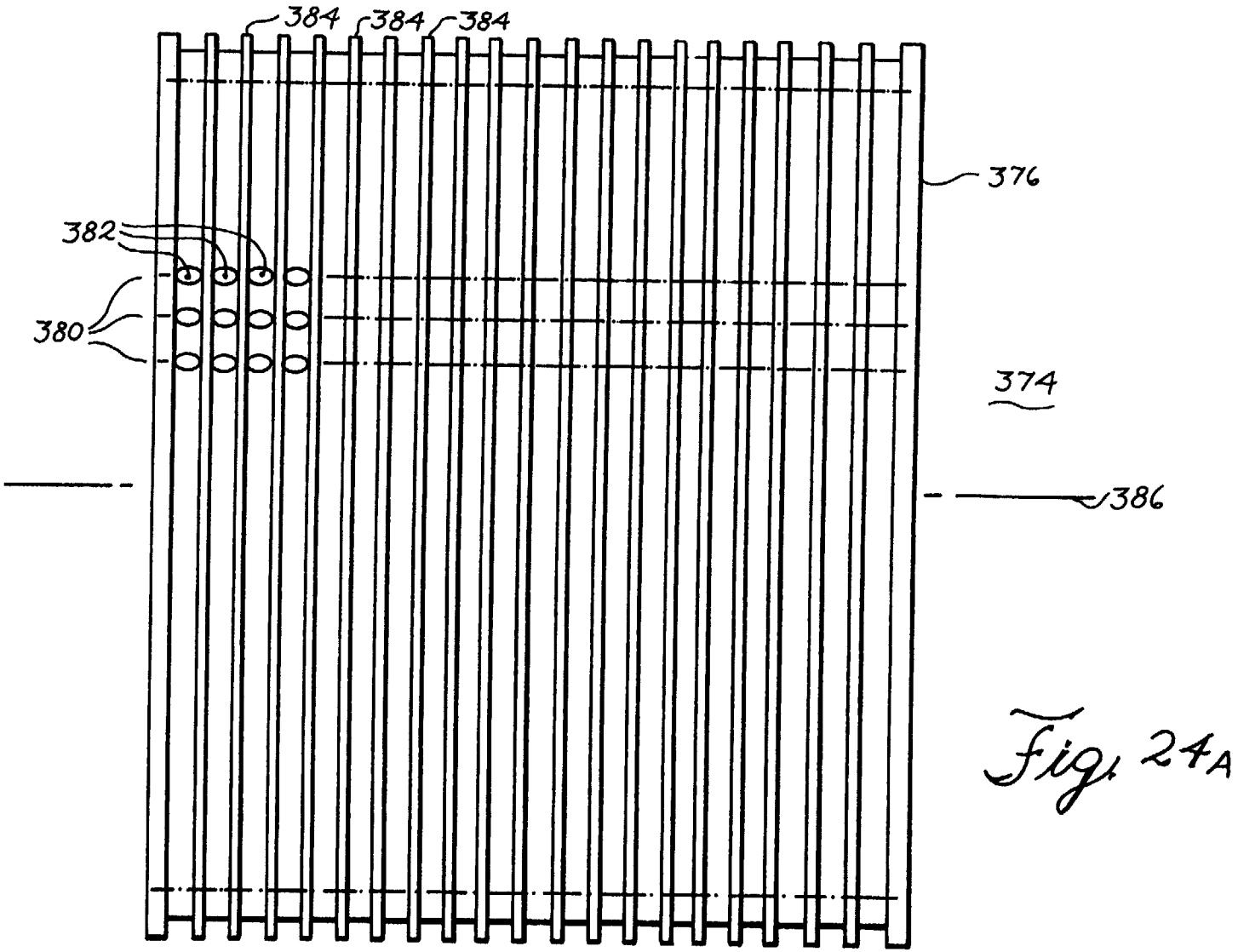
FIGS. 24A–C show another embodiment of a wheat and wild oats screen.
Figures 24B, 24C:
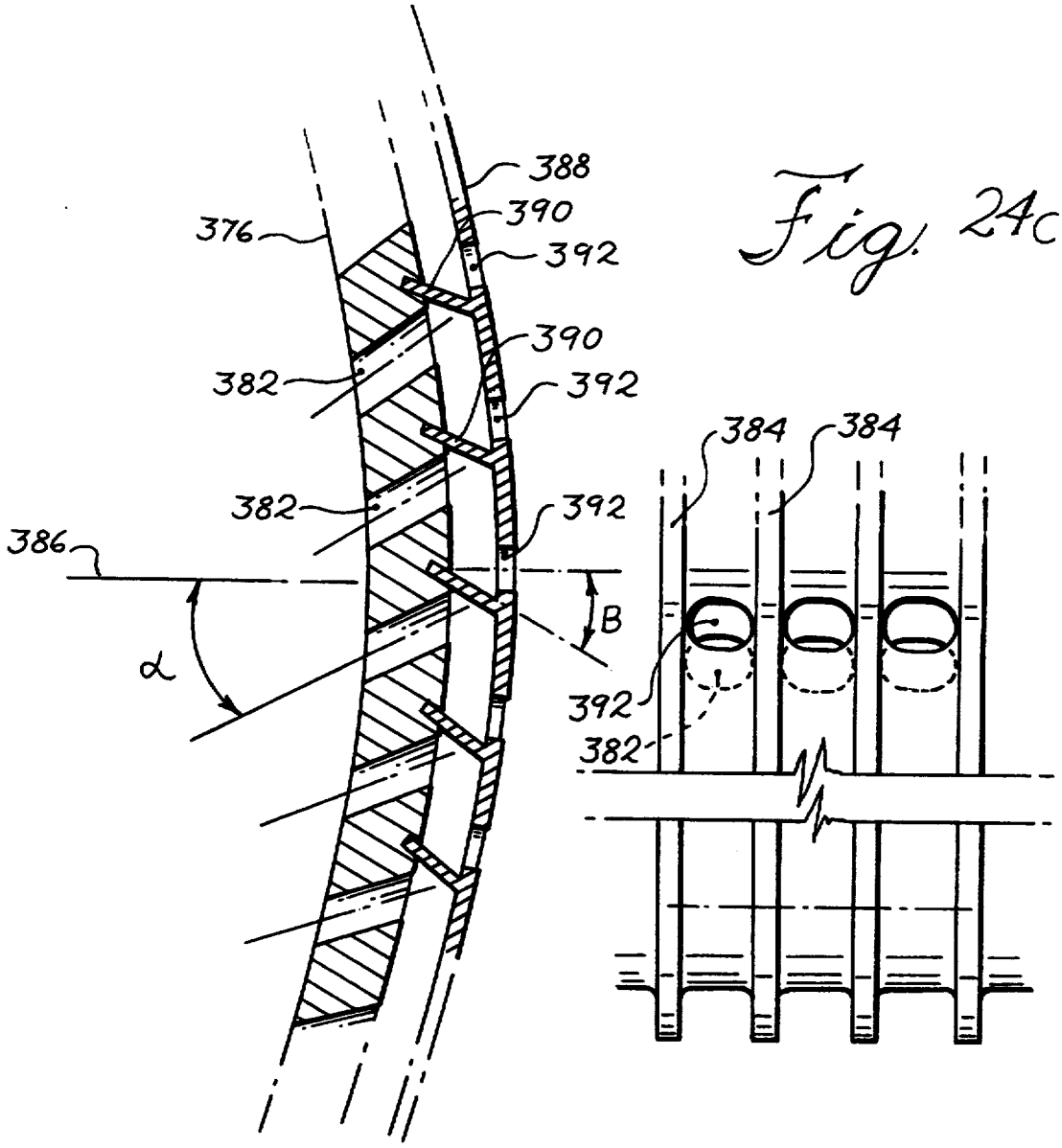

Another embodiment of a wild oat sieving section 374 is shown in FIGS. 24 A–C. Sieving section 374 comprises a first sieving layer 376 and a second sieving layer 378, wherein each is made of aluminum. First sieving layer 376 is cylindrical in shape and is attached to rotary sieve 200 in a manner similar to how sieving section 240 is attached to rotary sieve 200. First sieving layer 376 comprises a screen surface 378 comprising a number of perforations or openings arranged in 64 rows 380. Each row 380 is equally spaced from an adjacent row 380 by approximately 0.4167". Furthermore, each row extends along the length of the cylinder having approximately 20 holes 382 in each row. As seen in FIG. 24 A, each hole 382 is slot shaped and are separated from adjacent holes by annular dividers 384. Each annular dividers 384 is attached to the screen surface 378 in a well known manner. Each divider 384 has a thickness of approximately 0.50" and extend vertically from the screen surface 378 by approximately 0.188". Furthermore, adjacent dividers 384 are separated from each other by approximately 0.330. As shown in FIG. 24A, each hole 382 is elongated and extends between the dividers 384 and approximately has a diameter of 0.172". As shown in FIG. 24B, when layer 376 is in a cylindrical shape the channels formed by holes 384 define an angle theta with a horizontal axis 386. Theta is approximately 26°. Note that the cylinders outside diameter is approximately 8.488" and its inside diameter is approximately 7,925".

Attached to the first sieving layer 376 is a second sieving layer 388. As shown in FIG. 24B attachment is achieved by forming rectangular slots which extend between adjacent dividers 384 and are located between each adjacent hole 382. The slots have a depth of approximately 0.32" and are angled at an angle beta approximately 30° from the horizontal axis 386. In the slots are inserted corresponding aluminum baffle strips 390 attached to the inner surface of the second sieving layer 388 and aligned with the rectangular slot. The second sieving layer contains holes 392 which have a pattern and size which correspond to that of the first sieving layer 376. However, due to the angled baffle strips 390 holes 392 are offset from holes 382 as shown in FIG. 24C. Note that the junction where the baffle strips are attached to the second sieving layer are approximately aligned with the channels formed by holes 382.

As with the first embodiment, the first sieving layer and the second sieving layer are separated by a distance less than approximately the largest dimension of any of the wild oat kernels and greater than approximately the largest dimension of any of the wheat kernels. In other words, the separation distance is such that wheat kernel is able to "turn the corner" to wholly enter the space defined by the baffles and the dividers but wild oat kernel is unable to "turn the corner." As the cylinder rotates, the wild oat kernels eventually fall back through the openings of the first sieving layer and are augered to hopper 212. Furthermore, the wheat kernels eventually fall through holes 392 into hopper 210.

While various embodiments of the present invention have been shown and described herein, various changes are possible and will be understood as forming a part of the invention in so far as they fall within the spirit and scope of the appendant claims.

We claim:

1. A grain processor for separating and measuring components of a test sample of grain containing good grain and impurities, such as, light particles, small-sized impurities, medium-sized impurities, and large-sized impurities, said grain processor comprising:

a rotary sieve to receive said test sample of grain, wherein said sieve comprises a first sieving section and a second sieving section, wherein said first and second sieving sections have different size perforations;

a first recovery receptacle for receiving a portion of the sample sieved through the first sieving section;

a second recovery receptacle for receiving a portion of the sample sieved through the second sieving section.

2. The grain processor of claim 1, wherein said first recovery receptacle comprises a weighing sensor to weigh said portion of the sample contained in said first recovery receptacle; and wherein said second recovery receptacle comprises a weighing sensor to weigh said portion of the sample contained in said second recovery receptacle.

3. The grain processor of claim 2, comprising a processor unit.

4. The grain processor of claim 2, wherein said weighing sensor of said first recovery receptacle produces a first weighing signal which is received by said processing unit; wherein said weighing sensor of said second recovery receptacle produces a second weighing signal which is received by said processing unit.

5. The grain processor of claim 4, wherein said processing unit registers the weight of the grain present in each of said first and second recovery receptacles based on said first and second weighing signals.

6. The grain processor of claim 5, comprising a weighing sensor for measuring the gross weight of said sample before said sample is delivered to said rotary sieve.

7. The grain processor of claim 5, wherein said processing unit calculates the proportion of the sieved grain and different impurities with respect to the gross weight of the test sample of grain.

8. The grain processor of claim 6, wherein said processing unit calculates the proportion of the sieved grain and different impurities with respect to the gross weight of the test sample of grain.

9. The grain processor of claim 7, wherein said processing unit produces a signal to control said rotary sieve.

10. The grain processor of claim 8, wherein said processing unit produces a signal to control said rotary sieve.

11. A grain processor for separating and measuring components of a test sample of grain containing good grain and impurities, such as, light particles, small-sized impurities, medium-sized impurities, and large-sized impurities, said grain processor comprising:

a feed hopper to receive said test sample of grain;

a passage to transport said test sample from said feed hopper to a sieve;

an aspiration system connected to said passage and comprising a vacuum source to produce a subatmospheric pressure sufficient to impel said light particles to travel from said passage into said aspiration system;

said sieve receiving a remaining portion of said test sample of grain from said passage, wherein said sieve comprises a first sieving section and a second sieving section, wherein said first and second sieving sections have different size perforations;

a first recovery receptacle for receiving a first portion of the sample sieved through the first sieving section;

a second recovery receptacle for receiving a portion of the sample sieved through the second sieving section.

12. The grain processor of claim 11, wherein said first recovery receptacle comprises a weighing sensor to weigh said portion of the sample sieved through the first sieving section;

wherein said second recovery receptacle comprises a weighing sensor to weigh said portion of the sample sieved through the second sieving section.

13. The grain processor of claim 11, wherein said sieve comprises a third sieving section.

14. The grain processor of claim 13, comprising a third recovery receptacle for receiving a portion of the test sample sieved through said third sieving section, said third recovery receptacle comprises a weighing sensor to weigh said portion of the sample sieved through the third sieving section.

15. The grain processor of claim 14, comprising a fourth recovery receptacle for receiving light particles from said aspiration system.

16. The grain processor of claim 14, wherein said feed hopper comprises a weighing sensor to weigh said test sample before being delivered to said sieve.

17. The grain processor of claim 16, comprising a processing unit.

18. The grain processor of claim 17, wherein said weighing sensor of said first recovery receptacle produces a first weighing signal which is received by said processing unit; wherein said weighing sensor of said second recovery receptacle produces a second weighing signal which is received by said processing unit, wherein said weighing sensor of said third recovery receptacle produces a third weighing signal which is received by said processing unit; and wherein said weighing sensor of said feed hopper produces a fourth weighing signal which is received by said processing unit.

19. The grain processor of claim 18, wherein said processing unit registers the weight of the grain present in each of said first, second and third recovery receptacles and said feed hopper based on said first, second, third, and fourth weighing signals.

20. The grain processor of claim 19, wherein said fourth recovery receptacle comprises a weighing sensor to produce a signal corresponding to the weight of said light particles from said aspiration system.

21. The grain processor of claim 20, wherein said processing unit calculates the proportion of the sieved grain and different impurities with respect to the gross weight of the test sample of grain.

22. The grain processor of claim 17, wherein said processing unit produces a signal to control said rotary sieve.

23. A grain processor for separating and measuring components of a test sample of grain containing good grain and impurities, such as, light particles, small-sized impurities, medium-sized impurities, and large-sized impurities, said grain processor comprising:

a feed hopper to receive said test sample of grain, wherein said feed hopper comprises a weighing sensor to weigh said test sample before being delivered to a sieve;

a passage to transport said test sample from said feed hopper to a sieve;

an aspiration system connected to said passage and comprising a vacuum source to produce a sub-atmospheric pressure sufficient to impel said light particles to travel from said passage into said aspiration system;

said sieve receiving a remaining portion of said test sample of grain from said passage wherein said sieve comprises a first sieving section, a second sieving section and a third sieving section, wherein said first and second sieving sections have different size perforations;

a first recovery receptacle for receiving a first portion of the sample sieved through the first sieving section;

a second recovery receptacle for receiving a portion of the sample sieved through the second Sieving section;

a third recovery receptacle for receiving a portion of the test sample sieved through said third sieving section; and a processing unit wherein said processing unit produces a signal to control said vacuum source.

24. The grain processor of claim 15, comprising a fifth recovery receptacle for receiving said large-sized impurities which are not sieved through said first, second, and third sieving sections.

25. The grain processor of claim 24, comprising a tray containing said first, second, third, fourth, and fifth recovery receptacles.

26. The grain processor of claim 11, wherein said aspiration system further comprises a second passage directly connecting said vacuum source to said feed hopper so as to collect fine dust from said test sample.

27. The grain processor of claim 11, wherein said sieve rotates.

28. A grain processor for separating and measuring components of a test sample of grain containing good grain and impurities, such as, light particles, small-sized impurities, medium-sized impurities, and large-sized impurities, said grain processor comprising:

a feed hopper to receive said test sample of grain;

a sieve to receive said test sample of grain from a passage connected to said feed hopper, wherein said sieve comprises a first sieving section, a second sieving section, and a third sieving section, wherein said first, second, and third sieving sections have different size perforations;

a first recovery receptacle for receiving a first portion of the sample sieved through the first sieving section;

a second recovery receptacle for receiving a portion of the sample sieved through the second sieving section;

a third recovery receptacle for receiving a portion of the sample sieved through the third sieving section;

a tray having opening to insert and hold said first, second, and third recovery receptacles.

29. The grain processor of claim 28, comprising a fourth recovery receptacle for receiving said light particles.

30. The grain processor of claim 29, wherein said tray holds said fourth recovery receptacle.

31. The grain processor of claim 29, comprising a fifth recovery receptacle for receiving said large-sized impurities which have not been sieved through said first, second, and third sieving sections.

32. The grain processor of claim 31, wherein said tray holds said fifth recovery receptacle.

33. The grain processor of claim 28, comprising a tray support allowing said tray to move from a receiving position to receive said sample in said first, second, and third recovery receptacles to a retrieval position wherein said first, second, and third recovery receptacles are accessible for unloading their contents.

34. A grain processor for separating and measuring components of a test sample of grain containing good grain and impurities, such as, light particles, small-size impurities, medium-sized impurities, and large-sized impurities, said grain processor comprising:

a feed hopper to receive said test sample of grain;

a sieve to receive said test sample of grain from a passage connected to said feed hopper, wherein said sieve comprises a first sieving section, a second sieving section, and a third sieving section, wherein said first, second, and third sieving sections have different size perforations;

a first recovery receptacle for receiving a first portion of the sample sieved through the first sieving section;

a second recovery receptacle for receiving a portion of the sample sieved through the second sieving section;

a third recovery receptacle for receiving a portion of the sample sieved through the third sieving section;

a tray holding said first, second, and third recovery receptacles;

a tray support allowing said tray to move from a receiving position to receive said sample in said first, second, and third recovery receptacles to a retrieval position wherein said first, second, and third recovery receptacles are accessible for unloading their contents; and a tray sensor sensing when said tray is in said receiving or retrieval positions.

35. The grain processor of claim 34, wherein said tray sensor produces a lock signal to prevent said grain processor from operating when said tray is in said retrieval position.

36. A grain processor for separating and measuring components of a test sample of grain containing good grain and impurities, such as, light particles, small-sized impurities, medium-sized impurities, and large-sized impurities, said grain processor comprising:

a feed hopper to receive said test sample of grain;

a sieve to receive said test sample of grain from a passage connected to said feed hopper, wherein said sieve comprises a first sieving section, a second sieving section, and a third sieving section, wherein said first, second, and third sieving sections have different size perforations;

a first recovery receptacle for receiving a first portion of the sample sieved through the first sieving section;

a second recovery receptacle for receiving a portion of the sample sieved through the second sieving section;

a third recovery receptacle for receiving a portion of the sample sieved through the third sieving section;

a tray holding said first, second, and third recovery receptacles;

a tray support allowing said tray to move from a receiving position to receive said sample in said first, second, and third recovery receptacles to a retrieval position wherein said first, second, and third recovery receptacles are accessible for unloading their contents; and a lock mechanism which automatically locks said tray when positioned in the receiving position and the grain processor is operating.

37. A grain processor for separating and measuring components of a test sample of grain containing good grain and impurities, such as, light particles, small-sized impurities, medium-sized impurities, and large-sized impurities, said grain processor comprising:

a feed hopper to receive said test sample of grain;

a passage to transport said test sample from said feed hopper to a sieve;

an aspiration system connected to said passage and comprising a vacuum source to produce a sub-atmospheric pressure sufficient to impel said light particles to travel from said passage into said aspiration system;

a processing unit producing a signal to control said vacuum source;

said sieve receiving a remaining portion of said test sample of grain from said passage, wherein said sieve comprises a first sieving section and a second sieving section, wherein said first and second sieving sections have different size perforations;

a first recovery receptacle for receiving a first portion of the sample sieved through the first sieving section;

a second recovery receptacle for receiving a portion of the sample sieved through the second sieving section.

38. The grain processor of claim 37, wherein said first recovery receptacle comprises a weighing sensor to weigh said portion of the sample sieved through the first sieving section;

wherein said second recovery receptacle comprises a weighing sensor to weigh said portion of the sample sieved through the second sieving section.

39. The grain processor of claim 37, wherein said sieve comprises a third sieving section.

40. The grain processor of claim 39, comprising a third recovery receptacle for receiving a portion of the test sample sieved through said third sieving section, said third recovery receptacle comprises a weighing sensor to weigh said portion of the sample sieved through the third sieving section.

41. The grain processor of claim 40, comprising a fourth recovery receptacle for receiving light particles from said aspiration system.

42. The grain processor of claim 40, wherein said feed hopper comprises a weighing sensor to weigh said test sample before being delivered to said sieve.

43. The grain processor of claim 42, wherein said weighing sensor of said first recovery receptacle produces a first weighing signal which is received by said processing unit; wherein said weighing sensor of said second recovery receptacle produces a second weighing signal which is received by said processing unit, wherein said weighing sensor of said third recovery receptacle produces a third weighing signal which is received by said processing unit; and wherein said weighing sensor of said feed hopper produces a fourth weighing signal which is received by said processing unit.

44. The grain processor of claim 43, wherein said processing unit registers the weight of the grain present in each of said first, second and third recovery receptacles and said feed hopper based on said first, second, third, and fourth weighing signals.

45. The grain processor of claim 44, wherein said fourth recovery receptacle comprises a weighing sensor to produce a signal corresponding to the weight of said light particles from said aspiration system.

46. The grain processor of claim 45, wherein said processing unit calculates the proportion of the sieved grain and different impurities with respect to the gross weight of the test sample of grain.

47. The grain processor of claim 42, wherein said processing unit produces a signal to control said rotary sieve.

48. A grain processor for separating and measuring components of a test sample of grain containing good grain and impurities, such as, light particles, small-sized impurities, medium-sized impurities, and large-sized impurities, said grain processor comprising:

a feed hopper to receive said test sample of grain;

a passage to transport said test sample from said feed hopper to a rotary sieve that rotates at an angular velocity;

an aspiration system connected to said passage and comprising a vacuum source to produce a sub-atmospheric pressure sufficient to impel said light particles to travel from said passage into said aspiration system;

said rotary sieve receiving a remaining portion of said test sample of grain from said passage, wherein said sieve comprises a first sieving section and a second sieving section, wherein said first and second sieving sections have different size perforations;

a processing unit producing a signal to control said angular velocity of said rotary sieve to have a constant and non-zero value;

a first recovery receptacle for receiving a first portion of the sample sieved through the first sieving section;

a second recovery receptacle for receiving a portion of the sample sieved through the second sieving section.

49. The grain processor of claim 48, wherein said first recovery receptacle comprises a weighing sensor to weigh said portion of the sample sieved through the first sieving section;

wherein said second recovery receptacle comprises a weighing sensor to weigh said portion of the sample sieved through the second sieving section.

50. The grain processor of claim 48, wherein said sieve comprises a third sieving section.

51. The grain processor of claim 50, comprising a third recovery receptacle for receiving a portion of the test sample sieved through said third sieving section, said third recovery receptacle comprises a weighing sensor to weigh said portion of the sample sieved through the third sieving section.

52. The grain processor of claim 51, comprising a fourth recovery receptacle for receiving light particles from said aspiration system.

53. The grain processor of claim 51, wherein said feed hopper comprises a weighing sensor to weigh said test sample before being delivered to said sieve.

54. The grain processor of claim 53, wherein said weighing sensor of said first recovery receptacle produces a first weighing signal which is received by said processing unit; wherein said weighing sensor of said second recovery receptacle produces a second weighing signal which is received by said processing unit, wherein said weighing sensor of said third recovery receptacle produces a third weighing signal which is received by said processing unit; and wherein said weighing sensor of said feed hopper produces a fourth weighing signal which is received by said processing unit.

55. The grain processor of claim 54 wherein said processing unit registers the weight of the grain present in each of said first, second and third recovery receptacles and said feed hopper based on said first, second, third, and fourth weighing signals.

56. The grain processor of claim 55, wherein said fourth recovery receptacle comprises a weighing sensor to produce a signal corresponding to the weight of said light particles from said aspiration system.

57. The grain processor of claim 56, wherein said processing unit calculates the proportion of the sieved grain and different impurities with respect to the gross weight of the test sample of grain.

* * * * *

UNITED STATES PATENT AND TRADEMARK OFFICE

CERTIFICATE OF CORRECTION

PATENT NO. : 5,429,248
DATED : July 4, 1995
INVENTOR(S) : LeGigan et al.

It is certified that error appears in the above-indentified patent and that said Letters Patent is hereby corrected as shown below:

On the Title Page

In column 2, line 8 under "U.S. PATENT DOCUMENTS" delete "6/1991" and substitute --6/1994--.

Col. 20, claim 23, line 18 after "passage" insert --,--.

Col. 20, claim 23, line 27 delete "Sieving" and substitute --sieving--.

Col. 20, claim 23, line 32 after the first occurrence of "unit" insert --,--.

Col. 20, claim 28, line 21 delete "opening" and substitute --openings--.

Signed and Sealed this

Thirtieth Day of January, 1996

Bruce Lehman

*Attest:*

BRUCE LEHMAN

*Attesting Officer*

*Commissioner of Patents and Trademarks*